US010378140B2

(12) United States Patent
Del Pos et al.

(10) Patent No.: US 10,378,140 B2
(45) Date of Patent: Aug. 13, 2019

(54) LAUNDRY WASHING MACHINE WITH DETERGENT DRAWER COMPRISING A CONTROL PANEL

(71) Applicant: Electrolux Appliances Aktiebolag, Stockholm (SE)

(72) Inventors: Maurizio Del Pos, Pordenone (IT); Daniele Favaro, Venice (IT)

(73) Assignee: Electrolux Appliances Aktiebolag (SE)

( * ) Notice: Subject to any disclaimer, the term of this patent is extended or adjusted under 35 U.S.C. 154(b) by 397 days.

(21) Appl. No.: 15/036,906

(22) PCT Filed: Nov. 20, 2013

(86) PCT No.: PCT/EP2013/074284
§ 371 (c)(1),
(2) Date: May 16, 2016

(87) PCT Pub. No.: WO2015/074688
PCT Pub. Date: May 28, 2015

(65) Prior Publication Data

US 2016/0273150 A1 Sep. 22, 2016

(51) Int. Cl.
*D06F 39/02* (2006.01)
*D06F 33/02* (2006.01)
(Continued)

(52) U.S. Cl.
CPC ..... *D06F 39/028* (2013.01); *D06F 33/02* (2013.01); *D06F 39/005* (2013.01); *D06F 39/02* (2013.01);
(Continued)

(58) Field of Classification Search
CPC ..... D06F 39/005; D06F 33/02; D06F 39/02; D06F 39/028; D06F 39/022; D06F 39/088; D06F 2204/086; D06F 2212/00
See application file for complete search history.

(56) References Cited

U.S. PATENT DOCUMENTS 5,253,494 A * 10/1993 Frucco ..... D06F 39/028 68/12.18
2005/0274156 A1* 12/2005 Yang ..... D06F 39/028 68/17 R
(Continued)

FOREIGN PATENT DOCUMENTS

DE 102006012283 B3 3/2007
DE 102007028173 A1 12/2008
(Continued)

OTHER PUBLICATIONS

Machine Translation of DE 102007050920 to Dahlke, Dec. 2008.*
International Search Report dated Mar. 21, 2014 in corresponding international application No. PCT/EP2013/074284.

*Primary Examiner* — Michael E Barr
*Assistant Examiner* — Benjamin L Osterhout
(74) *Attorney, Agent, or Firm* — RatnerPrestia

(57) ABSTRACT

Laundry washing machine has a casing, a washing tub with its opening facing a laundry loading/unloading opening on a the front wall of the casing, an autodosing detergent dispenser for automatically dosing, on the basis of the selected washing cycle, the suitable amount/dose of detergent, softener and/or other washing agent, and feeding said amount/dose into the washing tub. An appliance control panel is located/arranged on a front side of the drawer-like supporting structure which is fitted/inserted in extractable manner into a drawer housing extending inside the casing underneath the upper worktop or top wall of the casing. The autodosing detergent dispenser has one or more detergent reservoirs. A detergent collecting chamber communicates with the inside of the washing tub. Each detergent reservoir has a respective detergent feeding pump structured to selectively suck the specific amount of the detergent, softener or other washing agent necessary for performing the selected washing cycle.

22 Claims, 11 Drawing Sheets

(51) Int. Cl.
*D06F 39/08* (2006.01)
*D06F 39/00* (2006.01)

(52) U.S. Cl.
CPC ..... *D06F 39/022* (2013.01); *D06F 39/088* (2013.01); *D06F 2204/086* (2013.01); *D06F 2212/00* (2013.01)

(56) References Cited

U.S. PATENT DOCUMENTS

2006/0000240 A1* 1/2006 Song ..... D06F 39/085 68/3 R
2009/0090141 A1* 4/2009 Deppermann ..... D06F 39/022 68/17 R
2010/0000025 A1 1/2010 Dalton et al.
2010/0000573 A1* 1/2010 Hendrickson ..... D06F 33/02 134/18
2011/0056250 A1* 3/2011 Kim ..... D06F 39/028 68/17 R
2011/0186098 A1* 8/2011 Hasse ..... D06F 39/022 134/56 R
2012/0060568 A1* 3/2012 Buso ..... D06F 39/02 68/17 R
2012/0096901 A1* 4/2012 Zattin ..... D06F 39/022 68/13 R
2012/0152290 A1* 6/2012 Brosnan ..... A47L 15/4418 134/115 R
2012/0159997 A1* 6/2012 Del Pos ..... D06F 39/022 68/13 R
2013/0175293 A1* 7/2013 Burgess ..... D06F 39/022 222/23
2015/0368848 A1* 12/2015 Del Pos ..... D06F 39/007 8/137

FOREIGN PATENT DOCUMENTS

DE 102007050920 B3 12/2008
DE 102007046555 A1 4/2009
DE 102007047599 A1 4/2009
DE 102009028062 A1 2/2011
EP 1553161 A1 7/2005
EP 1997949 A1 12/2008
EP 2251481 A1 11/2010
WO 2011128745 A2 10/2011

* cited by examiner

LAUNDRY WASHING MACHINE WITH DETERGENT DRAWER COMPRISING A CONTROL PANEL

The present invention relates to a laundry washing machine.

In particular, the present invention relates to a front-loading home laundry washing machine, to which the following description refers purely by way of example without this implying any loss of generality.

BACKGROUND

As is known, currently marketed front-loading home laundry washing machines generally comprise: a substantially parallelepiped-shaped outer boxlike casing structured for resting on the floor; a substantially bell-shaped washing tub which is suspended in floating manner inside the casing, directly facing a laundry loading/unloading through opening realized in the front wall of the casing; a substantially cylindrical, elastically-deformable bellows which connects the front opening of the washing tub to the laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; a substantially cylindrical, bell-shaped rotatable drum structured for housing the laundry to be washed, and which is fitted inside the washing tub with its concavity facing the laundry loading/unloading opening and is supported in axially rotating manner so as to be able to freely rotate about its substantially horizontally-oriented longitudinal axis; and an electrically-powered motor assembly which is structured for driving into rotation the rotatable drum about its longitudinal axis inside the washing tub.

Alike any other home laundry washing machine, this type of laundry washing machine furthermore comprises: a detergent dispensing assembly which is located inside the boxlike casing and is structured for selectively feeding into the washing tub, according to the washing cycle manually-selected by the user, a given amount of detergent, softener and/or other washing agent suitably mixed with fresh water arriving from the water mains; a fresh-water supply circuit which is structured for selectively drawing fresh water from the water mains according to the washing cycle manually-selected by the user, and channeling said water to the detergent dispensing assembly or directly to the washing tub; and finally an appliance control panel which is generally located on the front wall of the casing, above the laundry loading/unloading opening, and is structured for allowing the user to manually select the desired washing-cycle.

In most of the home laundry washing machines currently on the market, the detergent dispensing assembly is generally located above the washing tub, and is structured for selectively feeding into the beneath located washing tub a manually measured and pre-loaded amount of detergent, softener and/or other washing agent sufficient for performing a single washing cycle.

More in details, the detergent dispensing assembly generally comprises a detergent drawer which is typically divided into a number of detergent compartments each structured for being manually fillable with an amount of detergent, softener or other washing agent sufficient to perform a single washing cycle, and which is fitted/inserted in manually extractable manner into a completely recessed drawer housing whose entrance is generally located on the upper right or left corner of the front wall of the casing, above the laundry loading/unloading opening and beside the appliance control panel.

In the recent years, however, some high-end home laundry washing machines have been provided with a fully automatic, autodosing detergent dispenser which is structured for automatically batching/dosing, on the basis of the selected washing cycle, the suitable amount/dose of detergent, softener and/or other washing agent to be used during the selected washing cycle and feeding said amount/dose of detergent, softener and/or other washing agent into the washing tub.

More in details, this autodosing detergent dispenser generally comprises two detergent reservoirs which are structured for storing, respectively, a great quantity (for example one liter) of detergent, and a great quantity (for example half a liter) of softener or other washing agent, and which are located on a drawer-like supporting structure which, in turn, is fitted/inserted in manually extractable manner into a completely recessed drawer housing whose entrance is generally located on the front wall of the casing, above the laundry loading/unloading opening and beside the appliance control panel.

The autodosing detergent dispenser furthermore comprises, for each detergent reservoir, a respective electrically-powered detergent feeding pump which is located/incorporated on the drawer-like supporting structure and is able to selectively suck, from the corresponding detergent reservoir, the specific amount of the detergent, softener or other washing agent necessary and sufficient for performing the selected washing cycle, and to pump/channel said specific amount of the detergent, softener or other washing agent into a detergent mixing chamber which is located/incorporated into the drawer-like supporting structure and which is crossed by the fresh water flowing towards the washing tub. This implies that a branch of the fresh-water supply circuit extends up to the drawer-like supporting structure and is structured so as to channel across the detergent collecting chamber part of the fresh water directed towards the washing tub.

SUMMARY OF SELECTED INVENTIVE ASPECTS

An aim of the present invention is to simplify the structure of the automatic detergent dispenser and of the fresh-water supply circuit.

In compliance with the above aims, according an aspect of the present invention, there is provided a laundry washing machine comprising an outer casing, a washing tub which is arranged inside the casing with its opening or mouth directly facing a laundry loading/unloading opening realized on a the front wall of the casing, a detergent dispensing assembly which is structured for supplying detergent into the washing tub, a main fresh-water supply circuit which is structured for being connected to the water mains and for selectively channeling a flow of fresh water from the water mains to the detergent dispensing assembly and/or to the washing tub, and an appliance control panel which is structured for allowing the user to manually select the desired washing-cycle;

the laundry washing machine being characterized in that the detergent dispensing assembly comprises an autodosing detergent dispenser which is structured for automatically dosing, on the basis of the selected washing cycle, the suitable amount of detergent, softener and/or other washing agent to be used during the selected washing cycle, and which comprises: one or more detergent reservoirs each of which is structured for receiving a quantity of detergent, softener or other washing agent for performing a plurality of washing cycles; and, for each detergent reservoir, a respective detergent feeding pump which is structured to selectively suck, from the corresponding detergent reservoir, the amount of the detergent, softener or other washing agent for performing the selected washing cycle, and to pump/channel said specific amount of detergent, softener or other washing agent into a detergent collecting chamber fluidly communicating with the washing tub;

in that the laundry washing machine comprises a drawer-like supporting structure which is fitted/inserted in extractable manner into a corresponding drawer housing that extends inside the casing underneath an upper worktop or top wall of the casing, and communicates with the outside via a front entrance or opening provided at the front wall of the casing; the appliance control panel being incorporated on a front side of the drawer-like supporting structure; the one or more detergent reservoirs of the autodosing detergent dispenser being located/housed on the drawer-like supporting structure behind the appliance control panel, and said drawer-like supporting structure being movable between a retracted position in which the drawer-like supporting structure is completely recessed/inserted into the drawer housing, and an extracted position in which the drawer-like supporting structure partly juts out from the front wall of the casing so as to arrange the loading inlets or mouths of the one or more detergent reservoirs outside of the casing;

in that each detergent feeding pump permanently communicates with one between the corresponding detergent reservoir and the detergent collecting chamber regardless of the position of the drawer-like supporting structure; and in that the laundry washing machine furthermore comprises a movable connecting device which is structured to put in fluid communication each detergent feeding pump to the other between the detergent collecting chamber and the corresponding detergent reservoir, wherein said connecting device is movable together with the drawer-like supporting structure and is structured to fluidly couple each detergent feeding pump to the corresponding detergent reservoir or to the detergent collecting chamber when the drawer-like supporting structure is arranged in the retracted position, and to fluidly uncouple each detergent feeding pump from the corresponding detergent reservoir or the detergent collecting chamber when the drawer-like supporting structure is arranged in the extracted position.

Preferably, though not necessarily, the laundry washing machine is furthermore characterized in that each detergent feeding pump is at least partly located on the drawer-like supporting structure with the suction in permanent communication with the corresponding detergent reservoir; and in that the movable connecting device is structured to selectively fluidly couple each detergent feeding pump with the detergent collecting chamber.

Preferably, though not necessarily, the laundry washing machine is furthermore characterized in that each detergent feeding pump is arranged stationary inside the casing with the delivery of the detergent feeding pump in permanent fluid communication with the detergent collecting chamber; and in that the movable connecting device is structured to selectively fluidly couple each detergent feeding pump with the corresponding detergent reservoir.

Preferably, though not necessarily, the laundry washing machine is furthermore characterized in that the detergent collecting chamber of the autodosing detergent dispenser is located outside of the drawer-like supporting structure, stationary inside the outer casing.

Preferably, though not necessarily, the laundry washing machine is furthermore characterized in that the detergent collecting chamber is located outside the washing tub and is arranged between the drawer housing and the back wall or a sidewall of the outer casing.

Preferably, though not necessarily, the laundry washing machine is furthermore characterized in that the closed container or receptacle is located outside of the drawer housing, adjacent or adjoined to the drawer housing.

Preferably, though not necessarily, the laundry washing machine is furthermore characterized in that the closed container or receptacle is a separate piece attached to the drawer housing, or is at least partially realized in a one piece-construction with the drawer housing.

Preferably, though not necessarily, the laundry washing machine is furthermore characterized in that the detergent collecting chamber comprises a container or receptacle which is located outside of the drawer housing, as a separate piece attached to the drawer housing, or is at least partially realized in a one piece-construction with the drawer housing.

Preferably, though not necessarily, the laundry washing machine is furthermore characterized in that the movable connecting device comprises, for each detergent feeding pump, a respective delivery manifold which is arranged on a back side of the drawer-like supporting structure.

Preferably, though not necessarily, the laundry washing machine is furthermore characterized in that the movable connecting device comprises, for each detergent feeding pump, a respective delivery manifold, said delivery manifold protrudes from the back side of the drawer-like supporting structure, and is structured so as to directly face a corresponding pass-through opening or hole realized on a lateral wall of the detergent collecting chamber when the drawer-like supporting structure is arranged in the retracted position.

Preferably, though not necessarily, the laundry washing machine is furthermore characterized in that the movable connecting device comprises, for each detergent feeding pump, a respective delivery manifold, said delivery manifold pump is structured so as to plug/fit in easy extractable manner into the corresponding pass-through opening or hole realized on the detergent collecting chamber when the drawer-like supporting structure is arranged in the retracted position.

Preferably, though not necessarily, the laundry washing machine is furthermore characterized in that the autodosing detergent dispenser additionally comprises a first water supply circuit which is connected or incorporated to the fresh-water supply circuit, and is structured for selectively channeling some fresh into the detergent collecting chamber, so as to selectively flush/push any amount of detergent, softener or other washing agent out of the detergent collecting chamber and into the washing tub.

Preferably, though not necessarily, the laundry washing machine is furthermore characterized in that the appliance control panel is arranged substantially coplanar to the front wall of the casing when the drawer-like supporting structure is in the retracted position.

Preferably, though not necessarily, the laundry washing machine is furthermore characterized in that said detergent reservoir/s is/are housed into the drawer-like supporting structure in manually removable manner.

Preferably, though not necessarily, the laundry washing machine is furthermore characterized in that each detergent feeding pump is housed or incorporated into the corresponding detergent reservoir so as to be manually removable from the drawer-like supporting structure together with the corresponding detergent reservoir.

Preferably, though not necessarily, the laundry washing machine is furthermore characterized in that the each detergent feeding pump comprises a pumping assembly and an electric-motor assembly which are separated to one another, and are structured to reciprocally couple in a stable though easy detectable manner so as to allow the electric-motor assembly to drive the pumping assembly; the pumping assembly being housed into the drawer-like supporting structure so as to suck the detergent, softener or other washing agent from the corresponding detergent reservoir, and being fluidly coupled to the detergent collecting chamber via the movable connecting device; the electric-motor assembly, in turn, being stationary fixed inside the casing so as to be able to couple in a stable though easy detachable manner with the corresponding pumping assembly when the drawer-like supporting structure is arranged in the retracted position.

Preferably, though not necessarily, the laundry washing machine is furthermore characterized in that the detergent dispensing assembly also comprises a single-dose detergent dispenser which is housed inside the casing above the washing tub and is structured for selectively feeding into the washing tub an amount of detergent, softener and/or other washing agent sufficient for performing a single washing cycle.

Preferably, though not necessarily, the laundry washing machine is furthermore characterized in that the single-dose detergent dispenser is housed inside the casing horizontally beside the autodosing detergent dispenser.

Preferably, though not necessarily, the laundry washing machine is furthermore characterized in that the single-dose detergent dispenser comprises a detergent drawer which is manually fillable with a quantity of detergent, softener and/or other washing agent sufficient for performing a single washing cycle, and which is fitted/inserted in manually extractable manner into a corresponding drawer housing which extends inside the casing underneath the upper worktop or top wall of the casing, and communicates with the outside via a front entrance or opening which is realized on the front wall of the casing above the laundry loading/unloading opening and horizontally beside the front entrance or opening of the drawer housing of the drawer-like supporting structure.

Preferably, though not necessarily, the laundry washing machine is furthermore characterized in that the drawer housing of the detergent drawer has a substantially basin-shaped bottom portion which communicates with the inside of the washing tub via a suitable first connecting duct, and in that the detergent collecting chamber communicates with the inside of the washing tub via a second connecting duct which joins the first connecting duct immediately upstream of the washing tub.

Preferably, though not necessarily, the laundry washing machine is furthermore characterized in that the drawer housing of the detergent drawer has a substantially basin-shaped bottom portion which communicates with the inside of the washing tub via a suitable first connecting duct, and in that the detergent collecting chamber is a portion of said first connecting duct.

Preferably, though not necessarily, the laundry washing machine is furthermore characterized in that the drawer housing of the detergent drawer has a substantially basin-shaped bottom portion which communicates with the inside of the washing tub and in that the drawer housing of the detergent drawer of the single-dose detergent dispenser forms the detergent collecting chamber.

Preferably, though not necessarily, the laundry washing machine is furthermore characterized in that the detergent collecting chamber is arranged above the washing tub.

Preferably, though not necessarily, the laundry washing machine is furthermore characterized in that the detergent collecting chamber is incorporated into the washing tub.

BRIEF DESCRIPTION OF THE DRAWINGS

A non-limiting embodiment of the present invention will now be described, by way of example, with reference to the accompanying drawings, in which:

FIG. 11 is a section view of the FIG. 10 detergent dispensing assembly with parts in section and/or parts removed for clarity; whereas

DETAILED DESCTIPTION OF EXAMPLE EMBODIMENTS

Figure 1:
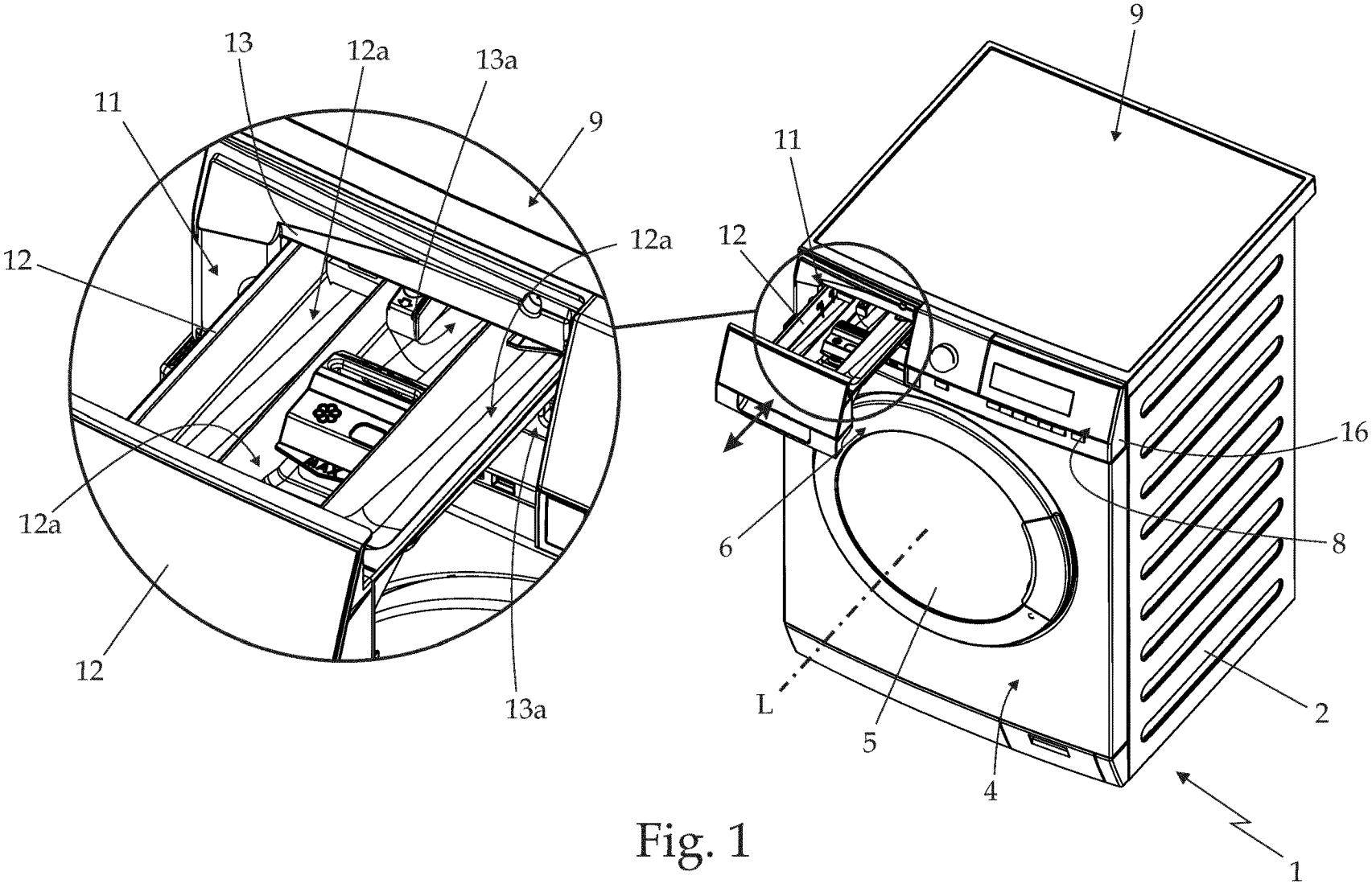
FIG. 1 is a perspective view of a front-loading, home laundry washing machine realized in accordance with the teachings of the present invention.
Figure 2:
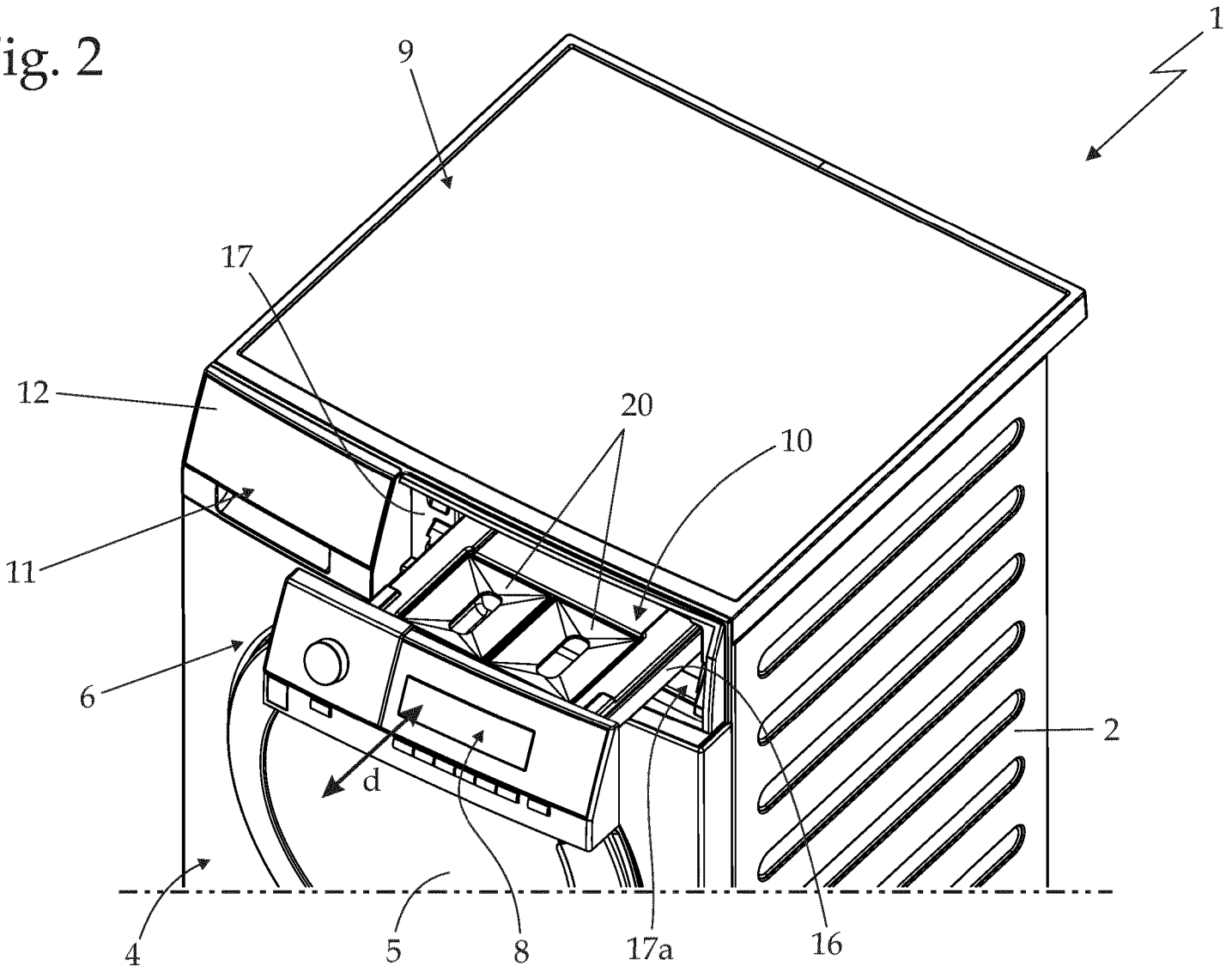
FIG. 2 is a perspective view of the FIG. 1 laundry washing machine in a different working configuration.
Figure 3:
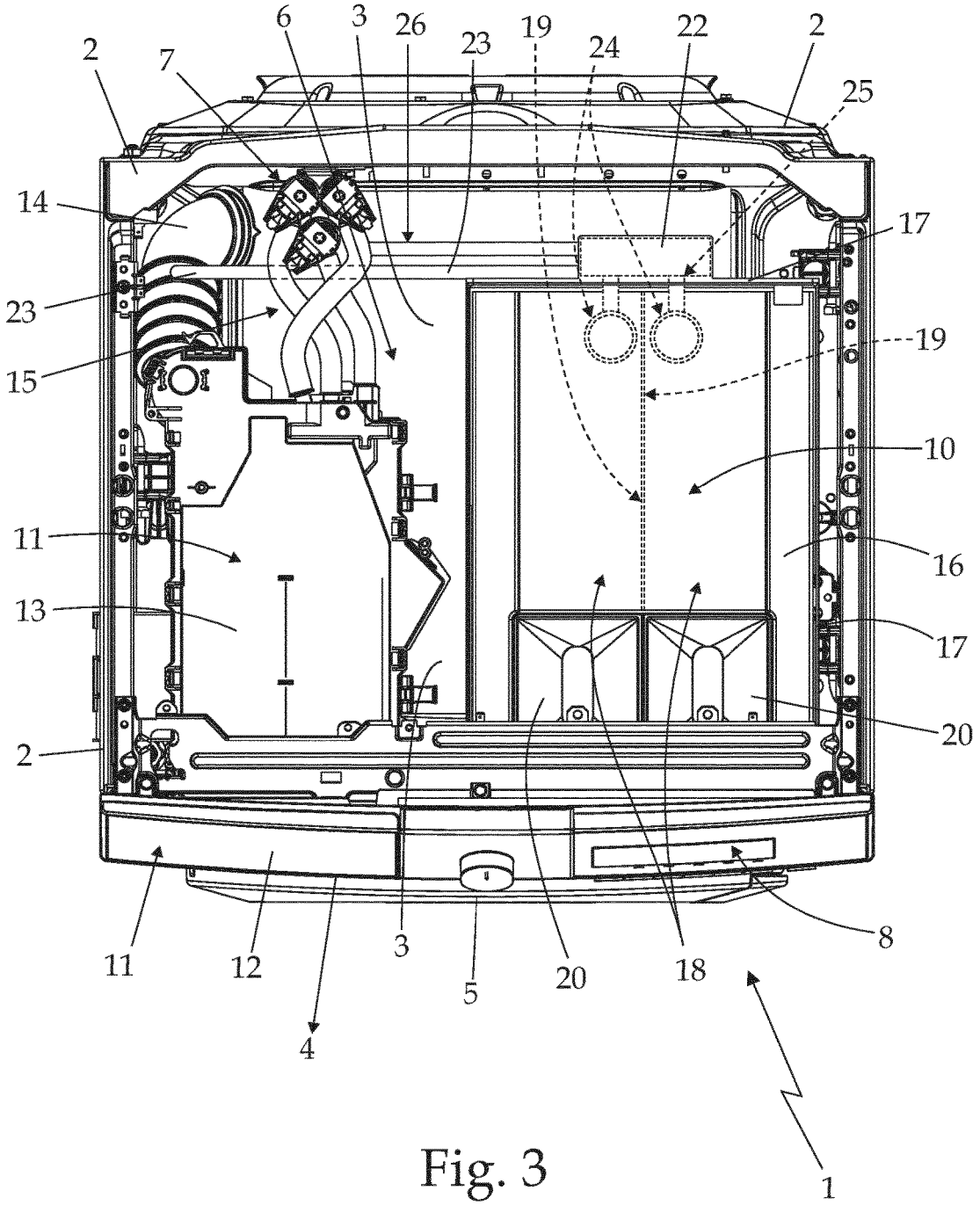
FIG. 3 is a top view of the FIG. 1 laundry washing machine showing the detergent dispensing assembly of the laundry washing machine.

With reference to FIGS. 1, 2 and 3, reference number 1 indicates as a whole a front-loading home laundry washing machine which comprises: a preferably, though not necessarily, substantially parallelepiped-shaped, rigid outer box-like casing 2 which is structured for resting on the floor; a preferably substantially cylindrical, bell-shaped hollow washing tub 3 which is arranged inside the casing 2 with its opening or mouth directly facing a laundry loading/unloading through opening (not shown) realized in the front wall 4 of casing 2; and a substantially cylindrical, bell-shaped rotatable drum (not shown) which is structured for housing the laundry to be washed, and is housed in axially rotatable manner inside the washing tub 3 so as to be able to freely rotate about its longitudinal reference axis.

In the example shown, in particular, the laundry loading/unloading opening is preferably realized on front wall 4 of casing 2 substantially astride of the vertical center-plane of the casing 2, and the front opening or mouth of the washing tub 3 is preferably watertight connected to the laundry loading/unloading opening realized on front wall 4 by means of a preferably substantially cylindrical, connecting bellows (not shown) preferably having an elastically-deformable structure.

Furthermore the washing tub 3 is preferably suspended in floating manner inside the casing 2 and is preferably arranged inside the boxlike casing 2 with its longitudinal reference axis L substantially horizontally-oriented, i.e. substantially perpendicular to front wall 4.

The rotatable drum (not shown), in turn, is housed in axially rotating manner inside the washing tub 3 with its front opening directly faced/aligned to the laundry loading/unloading opening on front wall 4, and the drum rotation axis is preferably arranged locally substantially coincident with the horizontally-oriented longitudinal reference axis L of washing tub 3.

With reference to FIGS. 1, 2 and 3, the front-loading laundry washing machine 1 furthermore comprises:

- a porthole door 5 which is hinged to the front wall 4 of casing 2 to rotate about a preferably, though not necessarily, vertically-oriented reference axis to and from a closing position (see FIGS. 1, 2 and 3) in which the peripheral border of the porthole door 5 rests completely on front wall 4 for closing the laundry loading/unloading opening and watertight sealing the washing tub 3;
- an electrically-powered motor assembly (not shown) which is housed inside the casing 2 and is structured for driving into rotation the rotatable drum (not shown) about its longitudinal reference axis inside the washing tub;
- a detergent dispensing assembly 6 which is housed inside the casing 2 in easily reachable manner by the user, and is structured for selectively feeding into the washing tub 3, according to the selected washing cycle, a given amount of detergent, softener and/or other washing agent preferably suitably mixed with the fresh water arriving from the water mains, or even simply a given amount of fresh water arriving from the water mains; and a main fresh-water supply circuit 7 which is structured for being connected to the water mains and for selectively channeling a flow of fresh water from the water mains to the detergent dispensing assembly 6 and/or directly to the washing tub 3, preferably while controlling/regulating the flowrate of fresh water directed towards the detergent dispensing assembly 6 and/or the washing tub 3.

Finally, the laundry washing machine 1 comprises an appliance control panel 8 which is structured for allowing the user to manually select the desired washing-cycle, and which is located on front wall 4 of casing 2, above the laundry loading/unloading opening, i.e. above the porthole door 5, and substantially immediately beneath the preferably substantially horizontally oriented, upper worktop or top wall 9 of the same casing 2.

The detergent dispensing assembly 6, in turn, comprises a fully automatic, autodosing detergent dispenser 10 which is structured for automatically batching/dosing, on the basis of the selected washing cycle, the suitable amount/dose of detergent, softener and/or other washing agent to be used during the selected washing cycle, and feeding said amount/dose of detergent, softener and/or other washing agent into the washing tub 3; and preferably, though not necessarily, also a single-dose detergent dispenser 11 which is housed inside the casing 2 above the washing tub 3, i.e. between the upper worktop or top wall 9 of casing 2 and the washing tub 3, and is structured for selectively feeding into the beneath located washing tub 3 a manually measured and pre-loaded amount of detergent, softener and/or other washing agent sufficient for performing only a single washing cycle.

With reference to FIGS. 1, 2 and 3, in particular, the single-dose detergent dispenser 11 preferably comprises a detergent drawer 12 which is manually fillable with a quantity of detergent, softener and/or other washing agent sufficient for performing only a single washing cycle, and which is fitted/inserted in manually extractable manner into a corresponding, completely recessed, drawer housing 13 which extends preferably substantially horizontally inside the boxlike casing 2 while remaining beneath the upper worktop or top wall 9 and above the washing tub 3, and communicates with the outside of casing 2 via a front entrance or opening 13*a* which is realized on front wall 4 of casing 2 above the laundry loading/unloading opening and underneath the upper worktop or top wall 9 of the casing 2.

In the example shown, in particular, the drawer housing 13 is preferably completely recessed inside the casing 2, immediately beneath the upper worktop or top wall 9 of the casing 2, so as to locate its front entrance or opening 13*a* on front wall 4 immediately beneath the front side edge of the upper worktop or top wall 9.

The detergent drawer 12, in turn, is preferably movable inside the drawer housing 13 along a preferably substantially horizontally-oriented, displacement direction between a retracted position (see FIGS. 2 and 3) in which the detergent drawer 12 is completely recessed inside the drawer housing 13, i.e. inside the casing 2, preferably while at same time closing the front entrance or opening 13*a* of the drawer housing 13; and a completely extracted position (see FIG. 1) in which the detergent drawer 12 partly juts out from the front wall 4 of casing 2 through the front entrance or opening 13*a* of the drawer housing 13 so as to allow easy manual refilling of the same detergent drawer 12.

In addition to the above, the detergent drawer 12 is preferably movable inside the drawer housing 13 along a substantially horizontally-oriented, displacement direction which is preferably locally substantially perpendicular to the front wall 4 of casing 2.

Preferably the drawer housing 13 also has a substantially basin-shaped bottom portion (not shown) which directly communicates with the inside of the beneath located washing tub 3 via a suitable connecting duct 14, and the single-dose detergent dispenser 11 preferably additionally comprises a water supply circuit 15 which is connected or incorporated to the fresh-water supply circuit 7, and is structured for selectively channeling/pouring, when the detergent drawer 12 is in the retracted position, a given amount of fresh water arriving from the water mains directly into the detergent drawer 12, so as to selectively flush/push the detergent, softener or other washing agent out of detergent drawer 12 and down on the bottom of the drawer housing 13. This mixture of water and detergent, softener or other washing agent afterwards flows into the washing tub 3 via the connecting duct 14 branching off from the basin-shaped bottom of drawer housing 13.

With reference to FIG. 1, in the example shown, in particular, the detergent drawer 12 is preferably divided into a number/plurality of detergent compartments 12*a* (three detergent compartments in the example shown) each of which is manually fillable with a respective given quantity of detergent, softener or other washing agent sufficient for performing only a single washing cycle; and the water supply circuit 15 of the single-dose detergent dispenser 11 is preferably structured for spilling/pouring the fresh water arriving from the fresh-water supply circuit 7 selectively and alternatively into any one of the detergent compartments 12*a* of detergent drawer 12, so as to selectively flush the detergent, softener or other washing agent out of the same detergent compartment 12*a* and down onto the bottom of drawer housing 13.

More in particular, in the example shown the water supply circuit 15 of the single-dose detergent dispenser 11 is preferably structured for selectively spilling/pouring a dense shower of water droplets by gravity directly into any one of the detergent compartments 12*a* of detergent drawer 12, so as to flush the detergent, softener or other washing agent out of the detergent comportment 12*a* and down onto the bottom of drawer housing 13.

With reference to FIGS. 1, 2, 3 and 4, the laundry washing machine 1 furthermore comprises a drawer-like supporting which is fitted/inserted in preferably manually extractable manner on front wall 4, above the laundry loading/unloading opening and beneath the upper worktop or top wall 9 of the casing 2. The appliance control panel 8 is incorporated on a front side of the drawer-like supporting structure 16, whereas the autodosing detergent dispenser 10 is at least partially located/housed into this drawer-like supporting structure 16 behind the appliance control panel 8.

In other words, the appliance control panel 8 is located/arranged on a front side of a drawer-like supporting structure 16 which is fitted/inserted in preferably manually extractable manner into a corresponding, completely recessed, drawer housing 17 which extends preferably substantially horizontally inside the casing 2 while remaining above the washing tub 3 and beneath the upper worktop or top wall 9, and communicates with the outside of casing 2 via a front entrance or opening 17*a* which is realized on front wall 4 of casing 2 above the laundry loading/unloading opening and beneath the upper worktop or top wall 9 of the casing 2; and the autodosing detergent dispenser 10 is at least partially located/incorporated/housed into this drawer-like supporting structure 16 behind the appliance control panel 8.

More in details, the autodosing detergent dispenser 10 comprises one or more detergent reservoirs 18 each of which is structured for receiving a great quantity (for example half a liter or one liter) of detergent, softener or other washing agent sufficient for performing a great number of washing cycles, and at least one and preferably each detergent reservoir 18 is arranged/located/housed on the drawer-like supporting structure 16 so as to allow the user to easily timely load the detergent, softener or other washing agent into the same detergent reservoir 18.

In the example shown, in particular, the drawer housing 17 is preferably completely recessed inside the casing 2, immediately beneath the upper worktop or top wall 9 of casing 2, so as to locate its front entrance or opening 17*a* on the front wall 4 of casing 2, immediately underneath the front side edge of the worktop or top wall 9 of casing 2.

With reference to FIGS. 1, 2 and 3, in the example shown, in particular, the front entrance or opening 17*a* of drawer housing 17 is preferably realized on front wall 4 of casing 2 horizontally beside the front entrance or opening 13*a* of drawer housing 13. Therefore in the example shown the autodosing detergent dispenser 10 is preferably housed inside the casing 2 horizontally beside the single-dose detergent dispenser 11.

In other words, the autodosing detergent dispenser 10 and the single-dose detergent dispenser 11 are preferably arranged inside the boxlike casing 2 one adjacent to the right sidewall of the casing 2 and the other adjacent to the left sidewall of the same casing 2.

More in detail, the drawer housing 13 of the single-dose detergent dispenser 11 is preferably arranged inside the boxlike casing 2 so as to locate its front entrance or opening 13*a* immediately beneath the upper worktop or top wall 9 of casing 2, approximately at the upper left corner of front wall 4; whereas the drawer housing 17 of the autodosing detergent dispenser 10 is preferably arranged inside the boxlike casing 2 so as to locate its front entrance or opening 17*a* immediately beneath the upper worktop or top wall 9 of casing 2 and beside the front entrance or opening 13*a* of drawer housing 13, approximately at the upper right corner of front wall 4.

Preferably the front entrance or opening 13*a* of drawer housing 13 is moreover arranged/located immediately adjacent to the left sidewall of casing 2, and the front entrance or opening 17*a* of drawer housing 17 is preferably arranged/located immediately adjacent to the front entrance or opening 13*a* of drawer housing 13 and extends horizontally beneath the upper worktop or top wall 9, from the front entrance or opening 13*a* of drawer housing 13 substantially up to the right sidewall of the same casing 2, i.e. beneath the remaining portion of the front side edge of the upper worktop or top wall 9 of casing 2.

With reference to FIGS. 1, 2, 3 and 4, the drawer-like supporting structure 16, in turn, is movable in a preferably substantially horizontally-oriented, displacement direction d between

- a retracted position (see FIGS. 1 and 3) in which the drawer-like supporting structure 16 is completely recessed/inserted into the drawer housing 17, so as to place/close the one or more detergent reservoirs 18 inside the casing 2 for hiding them to the user, i.e. for making them inaccessible to the user, and so as to arrange at same time the control panel 8 substantially coplanar to the front wall 4 of casing 2, at closure of the front entrance or opening 17*a* of the drawer housing 17; and
- a completely extracted position (see FIGS. 2 and 4) in which the drawer-like supporting structure 16 partly juts out from the front wall 4 of casing 2, so as to place/arrange the loading inlets or mouths of the one or more detergent reservoirs 18 completely outside of the casing 2 to make said loading inlets or mouths easy accessible to the user, and so as to arrange at same time the appliance control panel 8 forward spaced apart from the front wall 4 of casing 2 at maximum distance from front wall 4.

More in detail, in the example shown the drawer-like supporting structure 16 is preferably fitted/inserted in manually extractable manner into the completely recessed drawer housing 17, and is movable inside the drawer housing 17 along a substantially horizontally-oriented, displacement direction d which is preferably locally substantially perpendicular to front wall 3 of casing 2, and is therefore locally substantially parallel to the displacement direction of the detergent drawer 12 of the single-dose detergent dispenser 11.

Figure 4:
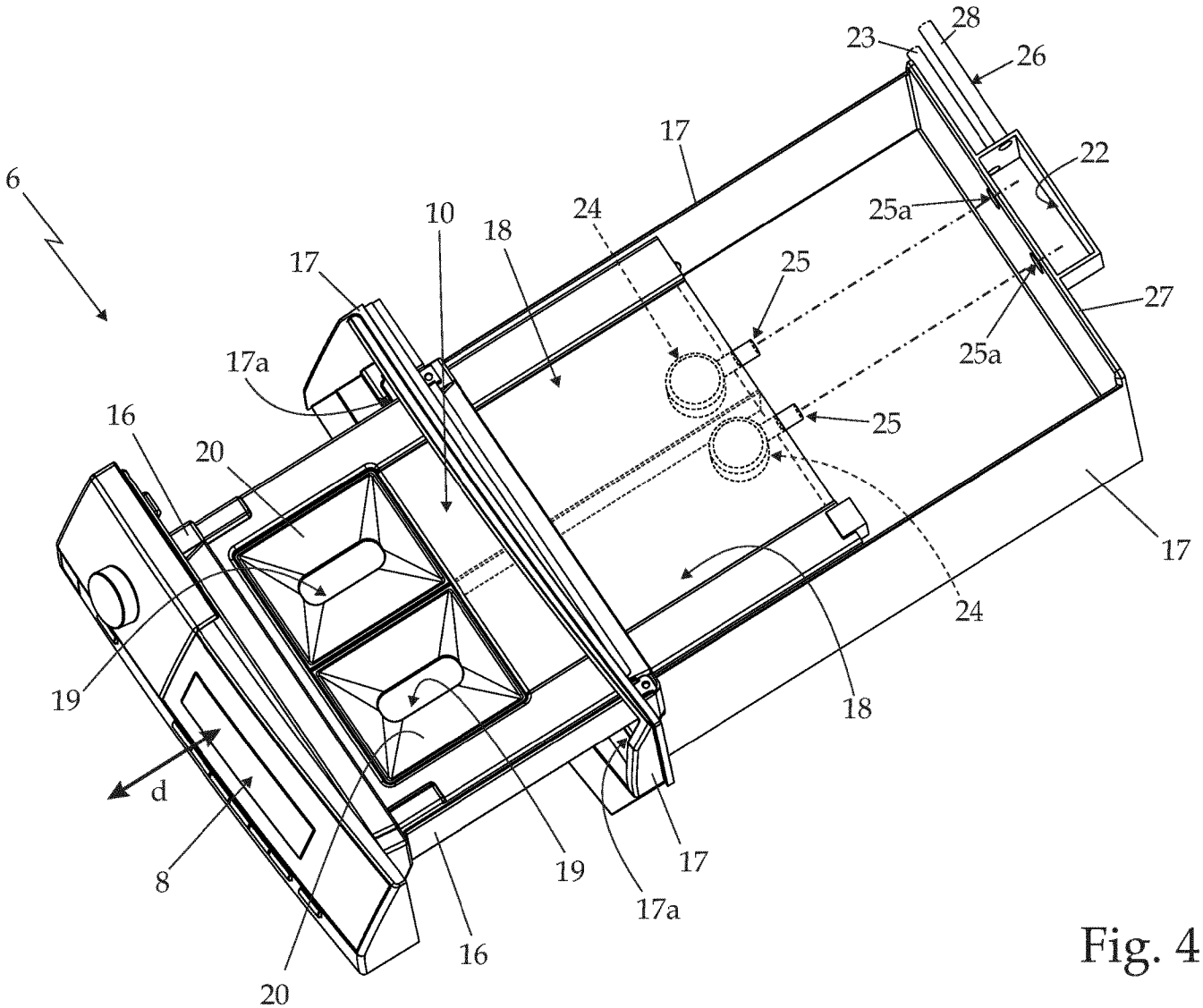
FIG. 4 is a perspective view of part of the FIG. 3 detergent dispensing assembly with parts in section and parts removed for clarity.

With reference to FIGS. 2, 3 and 4, in the example shown, in particular, the autodosing detergent dispenser 10 is preferably provided with two detergent reservoirs 18 which are structured for storing, respectively, a great quantity (for example one liter) of detergent, and a great quantity (for example half a liter) of softener or other washing agent.

Each of the two detergent reservoirs 18 is moreover arranged/located/housed on the drawer-like supporting structure 16.

More in detail, with reference to FIG. 4, in the example shown each detergent reservoir 18 preferably comprises a preferably substantially rectangular, basin-shaped container 19 which is realized/formed/incorporated directly on the drawer-like supporting structure 16, so that its upper opening or mouth is preferably arranged close to the front side of the drawer-like supporting structure 16, i.e. behind the appliance control panel 8, so as to be freely accessible by the user when the drawer-like supporting structure 16 is arranged in the extracted position (see FIGS. 2 and 4), and is completely hidden and inaccessible by the user when the drawer-like supporting structure 16 is arranged in the retracted position (see FIG. 1); and optionally also a preferably substantially funnel-shaped upper lid 20 which is coupled to the basin-shaped container 19 in a rigid and preferably also manually removable manner, at closure of the upper opening or mouth of the basin-shaped container 19.

With reference to FIGS. 3 and 4, the autodosing detergent dispenser 10 additionally comprises a detergent collecting chamber 22 which directly communicates with the inside of washing tub 3 preferably via a suitable connecting duct or pipeline 23; and, for each detergent reservoir 18, a respective electrically-powered detergent feeding pump 24 (two detergent feeding pumps 24 in the example shown) which is structured so as to be able to selectively suck, from the corresponding detergent reservoir 18, the specific amount of the detergent, softener or other washing agent necessary and sufficient for performing the selected washing cycle, and to pump/channel said specific amount of detergent, softener or other washing agent directly into the detergent collecting chamber 22.

More in particular, the detergent collecting chamber 22 is located/arranged immobile/stationary outside of the drawer-like supporting structure 16 and preferably also of the drawer housing 17; and at least one and preferably each detergent feeding pump 24 is located/housed on the drawer-like supporting structure 16 so as to permanently directly communicate with the corresponding detergent reservoir 18 regardless of the position of the drawer-like supporting structure 16, and is structured to selectively fluidly couple with the detergent collecting chamber 22 solely when the drawer-like supporting structure 16 is arranged in the retracted position, i.e. when the control panel 8 is arranged substantially coplanar to the front wall 4 of casing 2, so as to be able to transfer from the detergent reservoir 18 to the detergent collecting chamber 22 the specific amount of the detergent, softener or other washing agent necessary and sufficient for performing the selected washing cycle.

In other words, at least one and preferably each detergent feeding pump 24 is preferably located/housed on the drawer-like supporting structure 16 with the suction of the detergent feeding pump 24 in permanent communication with the corresponding detergent reservoir 18 so as to be able to suck the detergent, softener or other washing agent from the detergent reservoir 18.

The delivery of each detergent feeding pump 24 instead is fluidly connected to the detergent collecting chamber 22 via a movable connecting device 25 which is located on the drawer-like supporting structure 16 so as to move together with the drawer-like supporting structure 16, and is structured to fluidly couple the detergent feeding pump 24 to the detergent collecting chamber 22 when the drawer-like supporting structure 16 is arranged in the retracted position, thus allowing the detergent feeding pump 24 to deliver/channel into the detergent collecting chamber 22 the specific amount of the detergent, softener or other washing agent necessary and sufficient for performing the selected washing cycle; and to fluidly uncouple the detergent feeding pump 24 from the detergent collecting chamber 22 when the drawer-like supporting structure 16 is arranged in the extracted position thus preventing the detergent feeding pump 24 to deliver/channel into the detergent collecting chamber 22 any amount of the detergent, softener or other washing agent.

Therefore each detergent reservoir 18 is fluidly connected to the detergent collecting chamber 22 via the corresponding electrically-powered detergent feeding pump 24 and the connecting device 25, solely when the drawer-like supporting structure 16 is arranged in the retracted position, i.e. when the control panel 8 is arranged substantially coplanar to the front wall 4 of casing 2, at closure of the front entrance or opening 17*a* of the drawer housing 17.

In addition to the above, the autodosing detergent dispenser 10 preferably furthermore comprises a water supply circuit 26 which is connected or incorporated to the fresh-water supply circuit 7, and is structured for selectively channeling some fresh water of the water mains into the detergent collecting chamber 22, so as to selectively flush any amount of detergent, softener or other washing agent out of the detergent collecting chamber 22 and down into the washing tub 3 through the connecting duct or pipeline 23.

Figure 5:
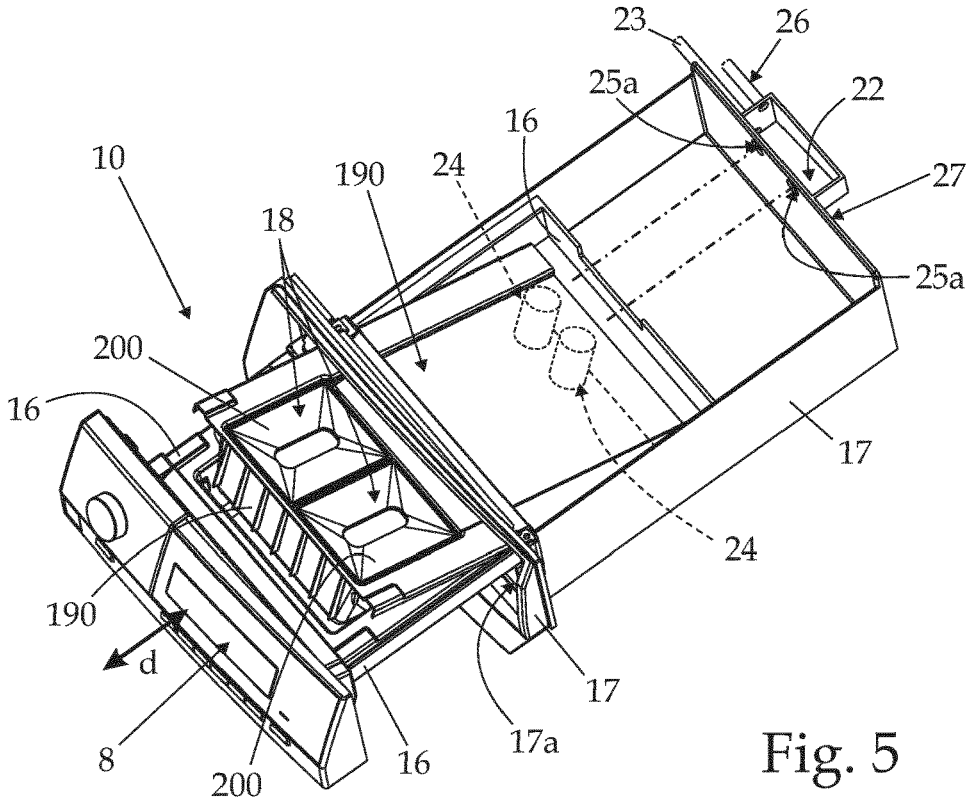
FIGS. 5 and 6 are two perspective views of two further embodiments of the FIG. 3 detergent dispensing assembly with parts in section and/or parts removed for clarity.

With reference to FIGS. 3, 4 and 5, in the example shown, in particular, the appliance control panel 8 and the detergent feeding pumps 24 of the autodosing detergent dispenser 10 are preferably electrically powered via an electric connector assembly comprising a male electric connector preferably located on the drawer-like supporting structure 16, and a complementary female electric connector preferably located on the drawer housing 17. These male and female electric connectors are structured to selectively couple to one another in easy detachable manner, and are arranged on the drawer-like supporting structure 16 and on the drawer housing 17 so as to couple to one another solely when the drawer-like supporting structure 16 is arranged in the retracted position.

Moreover, the autodosing detergent dispenser 10 may optionally also comprise, for each detergent reservoir 18, a respective level sensor (not shown) which is preferably, though not necessarily, located/housed on the drawer-like supporting structure 16 and is capable of determining the current level of the detergent, softener or other washing agent stored into the corresponding detergent reservoir 18.

In the example shown, in particular, each detergent feeding pump 24 is preferably a volumetric pump which is structured for selectively sucking a sequence of one or more basic amounts of detergent, softener or other washing agent from the corresponding detergent reservoir 18, and pumping/channeling said sequence of one or more basic amounts of detergent, softener or other washing agent towards the detergent collecting chamber 22 which, in turn, communicates with the washing tub 3. The sequence of one or more basic amounts of detergent or other washing agent forms the specific amount of the detergent or other washing agent necessary and sufficient for performing the selected washing cycle.

With reference to FIGS. 3 and 4, furthermore in the example shown the detergent collecting chamber 22 is preferably located/arranged outside of drawer housing 17, immediately adjacent or adjoined to the same drawer housing 17. Each electrically-powered detergent feeding pump 24, in turn, is preferably located/housed on the drawer-like supporting structure 16 with the suction permanently connected to the corresponding detergent reservoir 18, and fluidly couples with the detergent collecting chamber 22 so as to be able to deliver/channel into the detergent collecting chamber 22 the specific amount of the detergent, softener or other washing agent necessary and sufficient for performing the selected washing cycle, solely when the drawer-like supporting structure 16 is arranged in the retracted position.

In other words, each detergent feeding pump 24 is located/housed on the drawer-like supporting structure 16 with the suction preferably permanently connected to the corresponding detergent reservoir 18, whereas the connecting device 25 puts, when the drawer-like supporting structure 16 is arranged in the retracted position, the delivery of each detergent feeding pump 24 in fluidic communication with the detergent collecting chamber 22 so as to allow the detergent feeding pump 24 to deliver/channel into the detergent collecting chamber 22 the specific amount of the detergent, softener or other washing agent necessary and sufficient for performing the selected washing cycle.

With reference to FIGS. 3 and 4, in the example shown, in particular, the detergent collecting chamber 22 is preferably arranged above the washing tub 3, and is preferably a closed container or receptacle 22 which is preferably located/arranged outside of drawer-like supporting structure 16, between the drawer-like supporting structure 16 and the back wall of the casing 2, so as to be immediately adjacent to a back side of the drawer-like supporting structure 16 when the latter is arranged in the retracted position.

More in detail, in the example shown the detergent collecting chamber 22 is preferably a closed container or receptacle 22 which is preferably located/arranged outside of the drawer housing 17, adjacent or adjoined to the back wall 27 of drawer housing 17, i.e. between the drawer housing 17 and the back wall of the casing 2, so as to be immediately adjacent to a back side of the drawer-like supporting structure 16 when the latter is arranged in the retracted position.

Furthermore the detergent collecting chamber 22, i.e. the closed container or receptacle 22, preferably communicates with the inside of washing tub 3 via a connecting duct 23 which preferably, though not necessarily, joins the connecting duct 14 immediately upstream of washing tub 3.

With reference to FIGS. 3 and 4, in the example shown, in particular, the detergent collecting chamber 22 preferably comprises a substantially boxlike container 22 which is cantilevered arranged on the back wall 27 of drawer housing 17, preferably substantially at centre of the same back wall 27, and which is preferably also integrally formed with the same back wall 27 of drawer housing 17.

In other words, the boxlike container 22 is preferably at least partly realized in a one-piece construction with the back wall 27 of drawer housing 17, preferably via an injection moulding process.

More in detail, in the example shown the detergent collecting chamber 22 preferably consists in a closed compartment/receptacle 22 which is realized inside an outwards protruding portion of the back wall 27 of drawer housing 17.

As an alternative, the detergent collecting chamber 22 could comprises a completely separated, substantially boxlike container 22 which is firmly attached to the back wall 27 of drawer housing 17, i.e. between the drawer housing 17 and the back wall of the casing 2.

With reference to FIGS. 3 and 4, at least one and preferably each detergent feeding pump 24, in turn, is located/housed into the drawer-like supporting structure 16, preferably close to the back side of the drawer-like supporting structure 16, and the autodosing detergent dispenser 10 comprises, for each detergent feeding pump 24 located/housed on the drawer-like supporting structure 16, a respective delivery manifold 25 which is structured to fluidly couple with the detergent collecting chamber 22, solely and exclusively when the drawer-like supporting structure 16 is arranged in the retracted position. The delivery manifolds 25 of the detergent feeding pumps 24 form the movable connecting device 25.

More in particular, the delivery manifold 25 is preferably structured so as to be able to selectively fluidly couple with the detergent collecting chamber 22 located outside of the located outside of the drawer housing 17 solely when the drawer-like supporting structure 16 is arranged in the retracted position, while setting up a fluidic connection with the detergent collecting chamber 22 that allows the delivery manifold 25 to directly squirt/pour the detergent, softener or other washing agent directly into the detergent collecting chamber 22 located outside of the drawer housing 17.

In other words, each delivery manifold 25 is structured so as to directly squirt/pour the detergent, softener or other washing agent directly into the detergent collecting chamber 22.

In the example shown, in particular, the delivery manifold 25 of each detergent feeding pump 24 is preferably arranged on the back side of the drawer-like supporting structure 16 so as to face the back wall 27 of drawer housing 17, and is structured so as to able to set up a stable, though easily detachable, fluidic connection with the detergent collecting chamber 22 located behind the back wall 27 of drawer housing 17, when the drawer-like supporting structure 16 is arranged in the retracted position.

More in details, in the example shown the delivery manifold 25 of each detergent feeding pump 24 preferably protrudes from the back side of the drawer-like supporting structure 16 towards the back wall 27 of drawer housing 17, and is structured so as to be able to directly face, when the drawer-like supporting structure 16 is arranged in the retracted position, and preferably also to fit/insert in easy extractable manner into a preferably substantially complementary shaped, pass-through opening or hole **25*a* which is realized on a lateral wall of the closed container or receptacle 22**.

In other words, when the drawer-like supporting structure 16 is arranged in the retracted position, the delivery manifold 25 of each detergent feeding pump 24 is structured to align in front of a corresponding pass-through opening or hole **25*a* realized on a lateral wall of the closed container or receptacle 22, so as to directly communicate with the detergent collecting chamber 22 and be able to squirt/pour the detergent, softener or other washing agent directly into the detergent collecting chamber 22. Instead, when the drawer-like supporting structure 16 is arranged in the extracted position, the delivery manifold 25 of each detergent feeding pump 24 is greatly spaced apart from the back wall 27 of drawer housing 17 and from the corresponding pass-through opening or hole 25*a* realized on the lateral wall of the closed container or receptacle 22, and is therefore unable to communicate with the closed container or receptacle 22, i.e. with the detergent collecting chamber 22**.

In the example shown, in particular, the lateral wall of the closed container or receptacle 22 preferably coincides with a portion of the back wall 27 of drawer housing 17; whereas the delivery manifold 25 is preferably structured so as to extend beyond the back wall 27 of the drawer housing 17 when the drawer-like supporting structure 16 is arranged in the retracted position.

Therefore, when the drawer-like supporting structure 16 is arranged in the retracted position, the delivery manifold 25 of each detergent feeding pump 24 is allowed to substantially protrude inside the closed container or receptacle 22 for squirting/pouring the detergent, softener or other washing agent directly into the detergent collecting chamber 22.

With reference to FIGS. 3 and 4, the water supply circuit 26, in turn, preferably comprises a second connecting duct or pipeline 28 which connects the detergent collecting chamber 22, i.e. the closed container or receptacle 22, to the fresh-water supply circuit 7, and preferably also an electrically-controlled on-off valve or similar (not shown) which is arranged/interposed between the fresh-water supply circuit 7 and the connecting duct or pipeline 28 and is able to control/regulate the flow of fresh water towards the detergent collecting chamber 22.

General operation of the front-loading home laundry washing machine 1 is clearly inferable from the above description: the electronic central control unit of laundry washing machine 1, according to the washing cycle selected by the user on control panel 8, can use either the autodosing detergent dispenser 10 or the single-dose detergent dispenser 11, or even both devices, to selectively feed into the washing tub 3 the detergent, softener and/or other washing agent necessary to perform the washing cycle.

Moreover, if the detected level of the detergent, softener or other washing agent stored into any one of the detergent reservoirs 18 of the autodosing detergent dispenser 10 is too low, the electronic central control unit of laundry washing machine 1 can warn the user and optionally operate only with the single-dose detergent dispenser 11.

The advantages resulting from the particular layout of the autodosing detergent dispenser 10 inside the casing 2 are remarkable. The arrangement of the detergent collecting chamber 22 outside of the drawer housing 17, preferably adjacent or adjoined to the back wall 27 of drawer housing 17, i.e. between the drawer housing 17 and the back wall of the casing 2, allows to greatly simplify both the hydraulic connections between the detergent feeding pumps 24 and the detergent collecting chamber 22, and the structure of the water supply circuit 26, with all advantages concerned.

The detergent collecting chamber 22, in fact, is now located very close to the valve assembly of the fresh-water supply circuit 7, allowing to reduce the length of the connecting duct or pipeline 28 and to incorporate the on-off valve of the water supply circuit 26 into the valve assembly of the fresh-water supply circuit 7.

The arrangement of the detergent collecting chamber 22 out of the drawer-like supporting structure 16, instead, allows to significantly increase the load capacity of the detergent reservoirs 18 located/housed in the drawer-like supporting structure 16.

Last but not less important, the arrangement of the appliance control panel 8 on front side of the drawer-like supporting structure 16 and the arrangement of the detergent reservoirs 18 of the autodosing detergent dispenser 10 inside the drawer-like supporting structure 16, behind the appliance control panel 8, allows to greatly increase the load capacity of the detergent reservoirs 18.

Clearly, changes may be made to the front-loading laundry washing machine 1 as described above without, however, departing from the scope of the present invention.

For example, the drawer housing 17 may solely comprise the horizontal runners that support the drawer-like supporting structure 16. In which case, the detergent collecting chamber 22 is located inside the boxlike casing 2, adjacent to the empty space delimited by said runners and designed for receiving the drawer-like supporting structure 16.

With reference to FIG. 5, according to a further embodiment of the autodosing detergent dispenser 10, the detergent reservoir/s 18 is/are housed into the drawer-like supporting structure 16 in manually removable manner. Preferably, in this embodiment each electrically-powered detergent feeding pump 24 of the autodosing detergent dispenser 10 is furthermore housed or incorporated into the corresponding detergent reservoir 18 so as to be manually removable from the drawer-like supporting structure 16 together with the corresponding detergent reservoir 18.

More in details, in the example shown the autodosing detergent dispenser 10 preferably comprises a large, substantially basin-shaped common container 190 which is recessed/housed in manually detachable manner into the drawer-like supporting structure 16, so as to be manually removable when the drawer-like supporting structure 16 is arranged in the extracted position, and which is moreover divided into two independent compartments, one dimensioned for storing a great quantity (for example one liter) of detergent, and the other dimensioned for storing a great quantity (for example half a liter) of softener or other washing agent.

The substantially basin-shaped, common container 190 is therefore provided with two independent upper openings or mouths allowing the user to separately load/pour detergent and softener or other washing agent onto the corresponding compartment, and each of said upper openings or mouths is preferably covered by a preferably substantially funnel-shaped upper lid 200 which is preferably coupled to the common container 190 in a rigid and preferably also manually removable manner.

Each compartment of the substantially basin-shaped common container 190 therefore forms a respective detergent reservoir 18 of the autodosing detergent dispenser 10.

Furthermore the autodosing detergent dispenser 10 preferably comprises two electrically-powered detergent feeding pumps 24 which are stably located/housed inside the substantially basin-shaped common container 190 so that each detergent feeding pump 24 is able to selectively suck, from a corresponding compartment of the substantially basin-shaped common container 190, the specific amount of the detergent, softener or other washing agent necessary and sufficient for performing the selected washing cycle, and pump/channel said specific amount of detergent, softener or other washing agent directly into the detergent collecting chamber 22 when the drawer-like supporting structure 16 is arranged in the retracted position.

The delivery manifold (not shown) of each electrically-powered detergent feeding pump 24 furthermore protrudes from the substantially basin-shaped common container 190 beyond the back side of the drawer-like supporting structure 16, and is structured so as to able, when the drawer-like supporting structure 16 is arranged in the retracted position, to directly face and preferably also substantially fit/insert in easy extractable manner into a corresponding pass-through opening or hole **25*a* realized on the lateral wall of the closed container or receptacle 22, i.e. on the back wall 27 of drawer housing 17, so as to be able to squirt/pour the detergent, softener or other washing agent directly into the detergent collecting chamber 22**.

Figure 6:
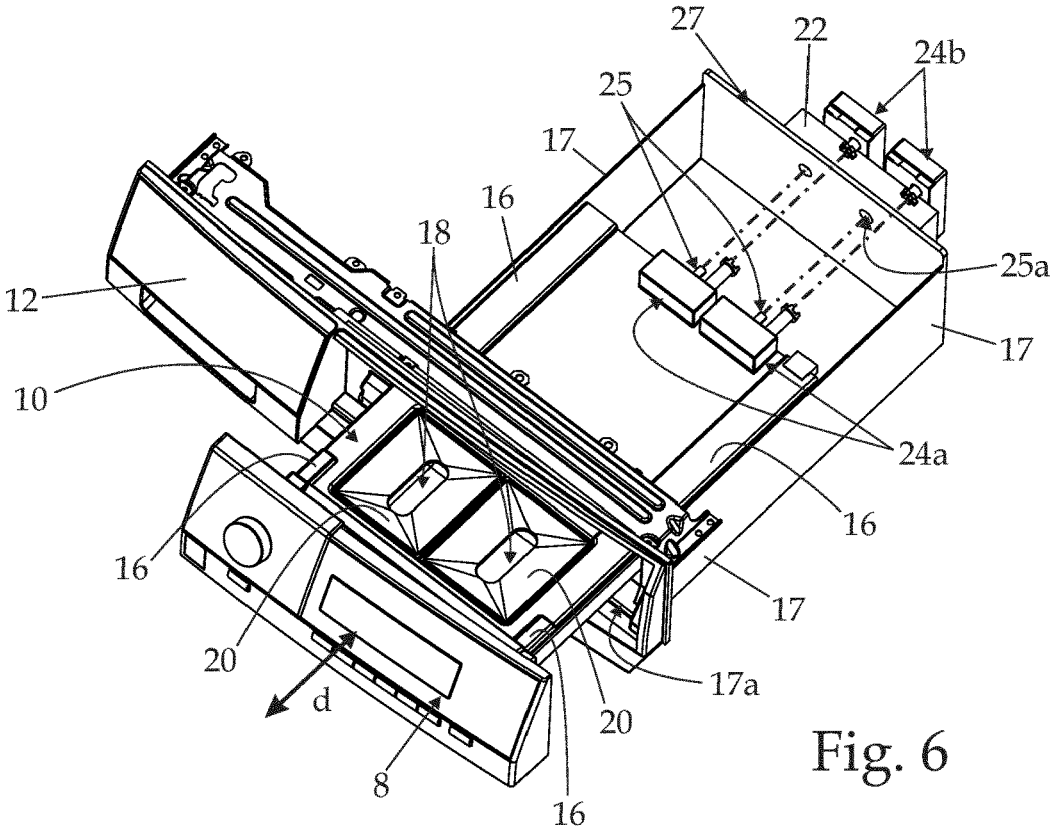

With reference to FIG. 6, according to a further and more sophisticated alternative embodiment of the autodosing detergent dispenser 10, at least one and preferably each electrically-powered detergent feeding pump 24 is divided into a pumping assembly 24*a* and an electric-motor assembly 24*b* which are completely separated to one another, and which are structured to reciprocally couple in a stable though easy detectable manner so as to allow the electric-motor assembly 24*b* to drive the pumping assembly 24*a*.

The pumping assembly 24*a* is located/housed into the drawer-like supporting structure 16 in direct communication with the corresponding detergent reservoir 18 and, when driven by the electric-motor assembly 24*b*, is capable of sucking from the corresponding detergent reservoir 18 the specific amount of the detergent, softener or other washing agent necessary and sufficient for performing the selected washing cycle, and of pumping/channeling said specific amount of detergent, softener or other washing agent directly into the detergent collecting chamber 22.

Alike the main embodiment, each pumping assembly 24*a* is selectively fluidly coupled to the detergent collecting chamber 22 via a delivery manifold 25 which is structured so as to able to directly squirt/pour the detergent, softener or other washing agent directly into the detergent collecting chamber 22 located outside of the drawer housing 17, solely and exclusively when the drawer-like supporting structure 16 is arranged in the retracted position.

In other words, the delivery manifold 25 of each pumping assembly 24*a* is structured so as to able to set up a fluidic connection with the detergent collecting chamber 22 located outside of the drawer housing 17 that allows, when the drawer-like supporting structure 16 is arranged in the retracted position, the delivery manifold 25 to directly squirt/pour the detergent, softener or other washing agent directly into the detergent collecting chamber 22.

More in details, delivery manifold 25 of the pumping assembly 24*a* preferably protrudes from the back side of the drawer-like supporting structure 16 towards the back wall 27 of drawer housing 17, and is structured so as to extend, when the drawer-like supporting structure 16 is arranged in the retracted position, beyond the back wall 27 of the drawer housing 17 and to directly face and preferably also fit/insert in easy extractable manner into a corresponding pass-through opening or hole 25*a* realized on the lateral wall of the closed container or receptacle 22, i.e. on the back wall 27 of drawer housing 17, so as to be able to squirt/pour the detergent, softener or other washing agent directly into the detergent collecting chamber 22.

The electric-motor assembly 24*b*, in turn, is stationary fixed inside the casing 3 so as to be able to couple in a stable though easy detachable manner with the corresponding pumping assembly 24*a* when the drawer-like supporting structure 16 is arranged in the retracted position, so to be able to drive the pumping assembly 24*a* when the drawer-like supporting structure 16 is arranged in the retracted position.

More in detail, the electric-motor assembly 24*b* is rigidly fixed to the drawer housing 17, preferably outside of the drawer housing 17 and preferably on the back wall 27, so as to be able to couple in a stable though easy detachable manner with the corresponding pumping assembly 24*a* when the drawer-like supporting structure 16 is arranged in the retracted position, so to be able to drive the pumping assembly 24*a* when the drawer-like supporting structure 16 is arranged in the retracted position.

In other words, when the drawer-like supporting structure 16 is arranged in the retracted position, the pumping assembly 24*a* and the electric-motor assembly 24*b* are allowed to couple to one another so as to form a detergent feeding pump 24 which is able to selectively suck, from the corresponding detergent reservoir 18, the specific amount of the detergent, softener or other washing agent necessary and sufficient for performing the selected washing cycle, and pump/channel said specific amount of detergent, softener or other washing agent directly into the detergent collecting chamber 22.

Figure 7:
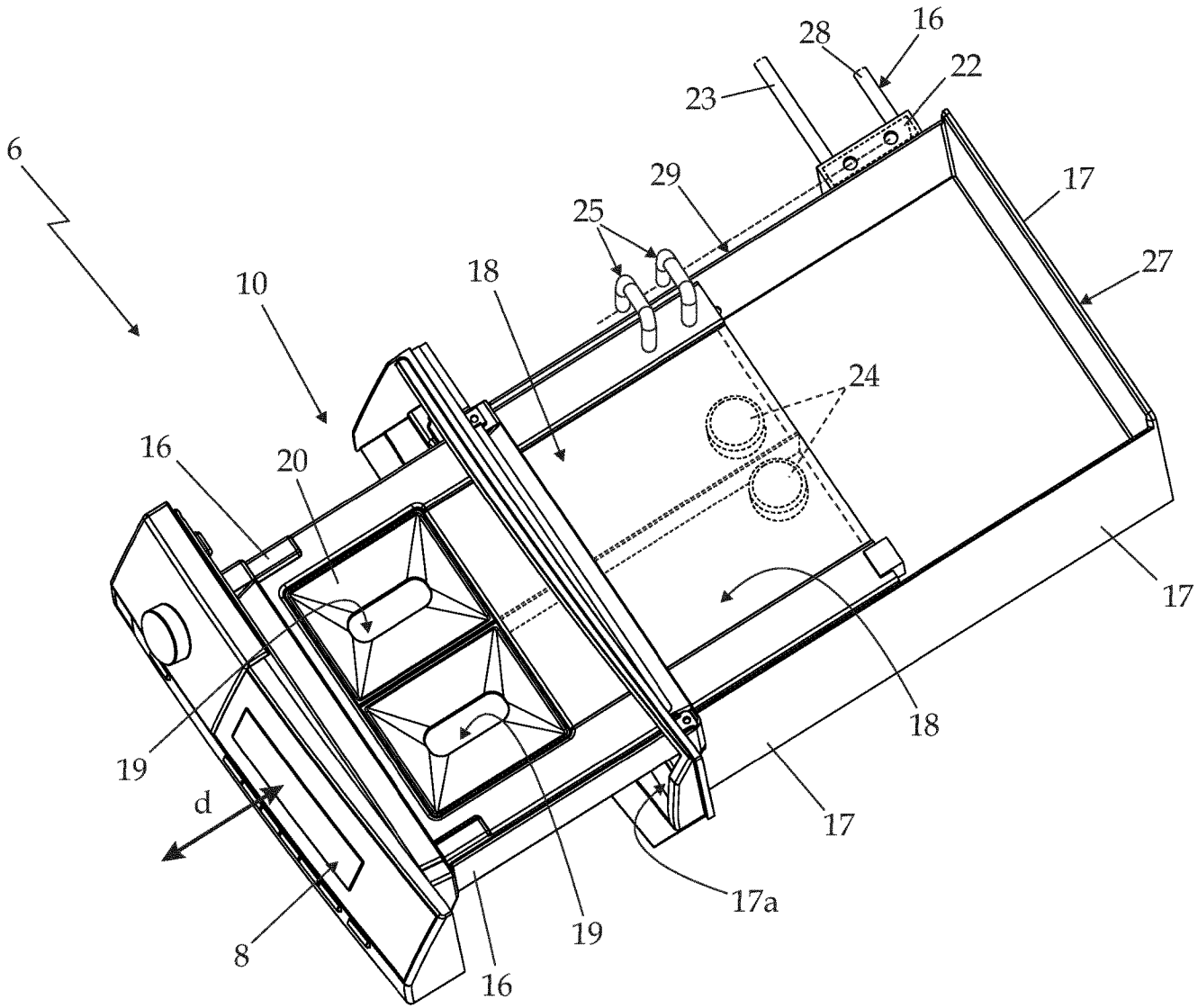
FIG. 7 is a perspective view of another embodiment of the detergent dispensing assembly.

With reference to FIG. 7, according to a further alternative embodiment of the autodosing detergent dispenser 10, the detergent collecting chamber 22 preferably comprises a closed container or receptacle 22 which is located/arranged outside of the drawer-like supporting structure 16, between the drawer-like supporting structure 16 and the right or left side wall of appliance casing 2.

More in particular, in this alternative embodiment the detergent collecting chamber 22 preferably comprises a closed container or receptacle 22 which is located/arranged outside of the drawer housing 17, immediately adjacent or adjoined to a sidewall 29 of drawer housing 17, i.e. between the drawer housing 17 and the right or left side wall of appliance casing 2. Furthermore the closed container or receptacle 22 is preferably, though not necessarily, also arranged close to the back wall 27 of drawer housing 17.

Furthermore, in this embodiment at least one and preferably each detergent feeding pump 24 of the autodosing detergent dispenser 10 are located/housed into the drawer-like supporting structure 16, and the autodosing detergent dispenser 10 comprises, for each detergent feeding pump 24, a delivery manifold 25 which is structured so as to able to directly squirt/pour the detergent, softener or other washing agent directly into the detergent collecting chamber 22 located outside of the drawer housing 17, solely and exclusively when the drawer-like supporting structure 16 is arranged in the retracted position.

More in details, the delivery manifold 25 of each detergent feeding pump 24 preferably protrudes a the lateral side of the drawer-like supporting structure 16 towards the sidewall 29 of drawer housing 17, and is structured so as to extend beyond the sidewall 29 when the drawer-like supporting structure 16 is arranged in the retracted position, and to directly face a preferably substantially complementary shaped, pass-through opening or hole 25*a* which is realized on a top wall of the closed container or receptacle 22. Therefore, when the drawer-like supporting structure 16 is arranged in the retracted position, the delivery manifold 25 of each detergent feeding pump 24 has the outlet mouth vertically aligned immediately above a corresponding pass-through opening or hole 25*a* realized on the top wall of the closed container or receptacle 22, so as directly squirt/pour the detergent, softener or other washing agent directly into the detergent collecting chamber 22.

Figure 8:
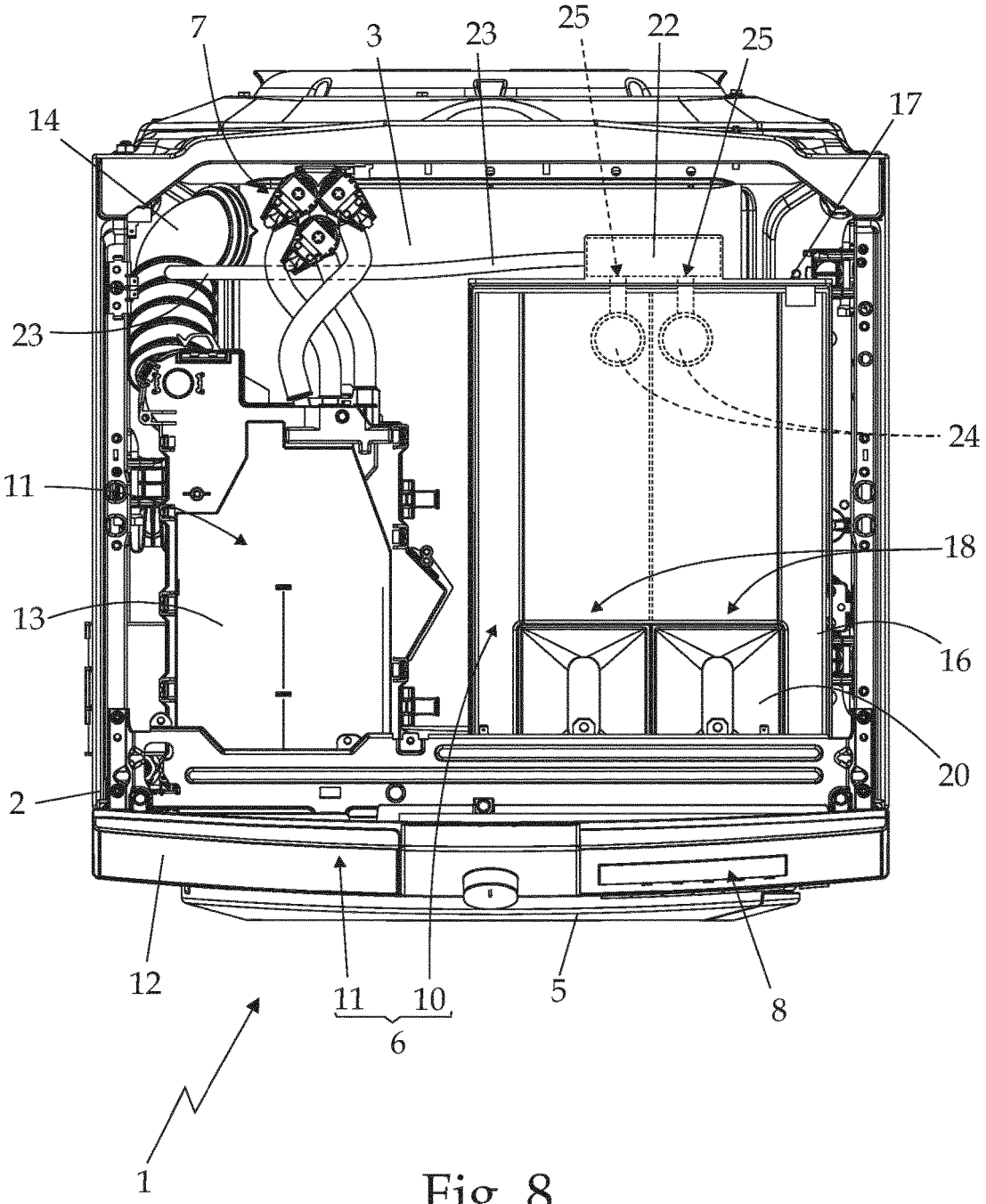
FIG. 8 is a top view of a further embodiment of the FIG. 3 detergent dispensing assembly with parts in section and/or parts removed for clarity.

With reference to FIG. 8, according to a further and less sophisticated alternative embodiment of the autodosing detergent dispenser 10, the autodosing detergent dispenser 10 may lack the water supply circuit 26 that selectively flushes any amount of detergent, softener or other washing agent out of the detergent collecting chamber 22. In this embodiment, any amount of detergent, softener or other washing agent channeled into the detergent collecting chamber 22 by the detergent feeding pump/s 24 flows by gravity into the washing tub 3 through the connecting duct or pipeline 23.

Obviously if the detergent collecting chamber 22 is incorporated into the connecting duct 14 or into the washing tub 3, the connecting duct or pipeline 23 is no more necessary.

Figure 9:
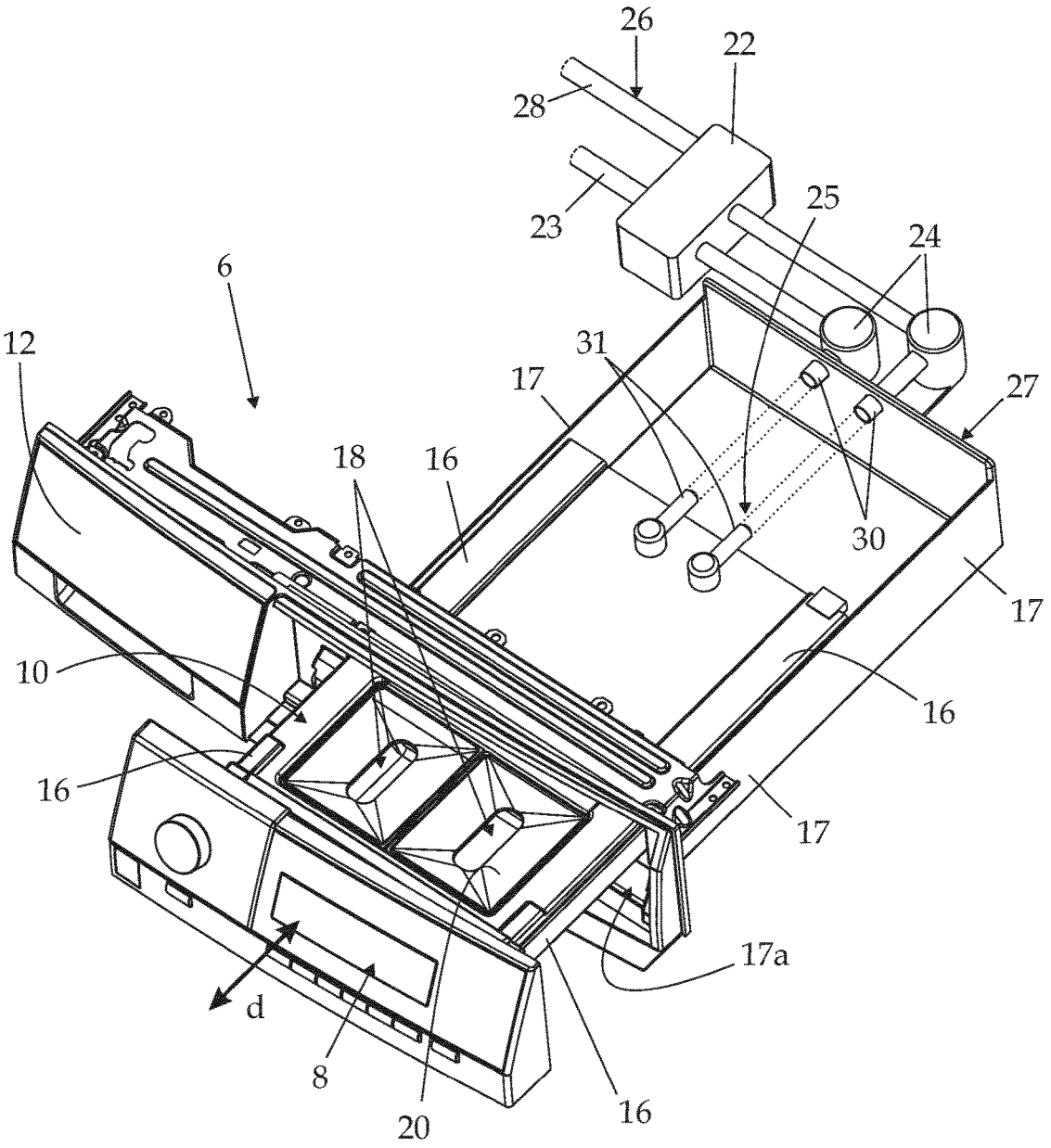
FIG. 9 is a perspective view of a further less-sophisticated embodiment of the FIG. 3 detergent dispensing assembly with parts in section and/or parts removed for clarity.

With reference to FIG. 9, according to a further alternative embodiment of the autodosing detergent dispenser 10, the detergent collecting chamber 22 preferably comprises a completely separated, container 22 which is located/arranged outside of the drawer housing 17, spaced apart from either the back wall 27 or the sidewall 29 of drawer housing 17. The detergent collecting chamber 22 is preferably therefore located between the drawer housing 17 and either the back wall of appliance casing 2, or the right or left sidewalls of appliance casing 2.

In this embodiment, at least one and preferably each electrically-powered detergent feeding pump 24 is rigidly fixed to the drawer housing 17, outside of the drawer housing 17, and preferably on the back wall 27 of the drawer housing 17.

In other words, at least one and preferably each electrically-powered detergent feeding pump 24 is arranged stationary inside the outer casing 2.

Moreover at least one and preferably each detergent feeding pump 24 permanently directly communicates with the detergent collecting chamber 22, and is structured to selectively fluidly couple with the corresponding detergent reservoir 18 housed into the drawer-like supporting structure 16 solely when the drawer-like supporting structure 16 is arranged in the retracted position In other words, the delivery of the detergent feeding pump 24 preferably permanently directly communicates with the inside of the detergent collecting chamber 22 regardless of the position of the drawer-like supporting structure 16. The suction of each detergent feeding pump 24 in turn is fluidly connected to the corresponding detergent reservoir 18 housed/located into the drawer-like supporting structure 16, via a movable connecting device 25 which is located on the drawer-like supporting structure 16 so as to move together with the drawer-like supporting structure 16, and is structured

- to fluidly couple the detergent feeding pump 24 to the corresponding detergent reservoir 18 when the drawer-like supporting structure 16 is arranged in the retracted position, thus allowing the detergent feeding pump 24 to suck from the corresponding detergent reservoir 18 the specific amount of the detergent, softener or other washing agent necessary and sufficient for performing the selected washing cycle; and
- to fluidly uncouple the detergent feeding pump 24 from the corresponding detergent reservoir 18 when the drawer-like supporting structure 16 is arranged in the extracted position thus preventing the detergent feeding pump 24 to suck from the corresponding detergent reservoir 18 any amount of the detergent, softener or other washing agent.

In this alternative embodiment, in particular, the movable connecting device 25 preferably comprises part of a self-closing hydraulic connector assembly formed by a first coupling member 30 located on the drawer housing 17, and a second coupling member 31 located on the drawer-like supporting structure 16. These first and second coupling members 30 and 31 are structured to selectively couple to one another in easy detachable manner, and are arranged on the drawer-like supporting structure 16 and on the drawer housing 17 so as to couple to one another solely when the drawer-like supporting structure 16 is arranged in the retracted position.

More specifically, in the example shown the first coupling member 30 of the self-closing hydraulic connector assembly is preferably located on the back wall 27 of drawer housing 17, and the second coupling member 31 of the self-closing hydraulic connector assembly is preferably located on the back side of the drawer-like supporting structure 16, locally axially aligned to the first coupling member 30.

Figure 10:
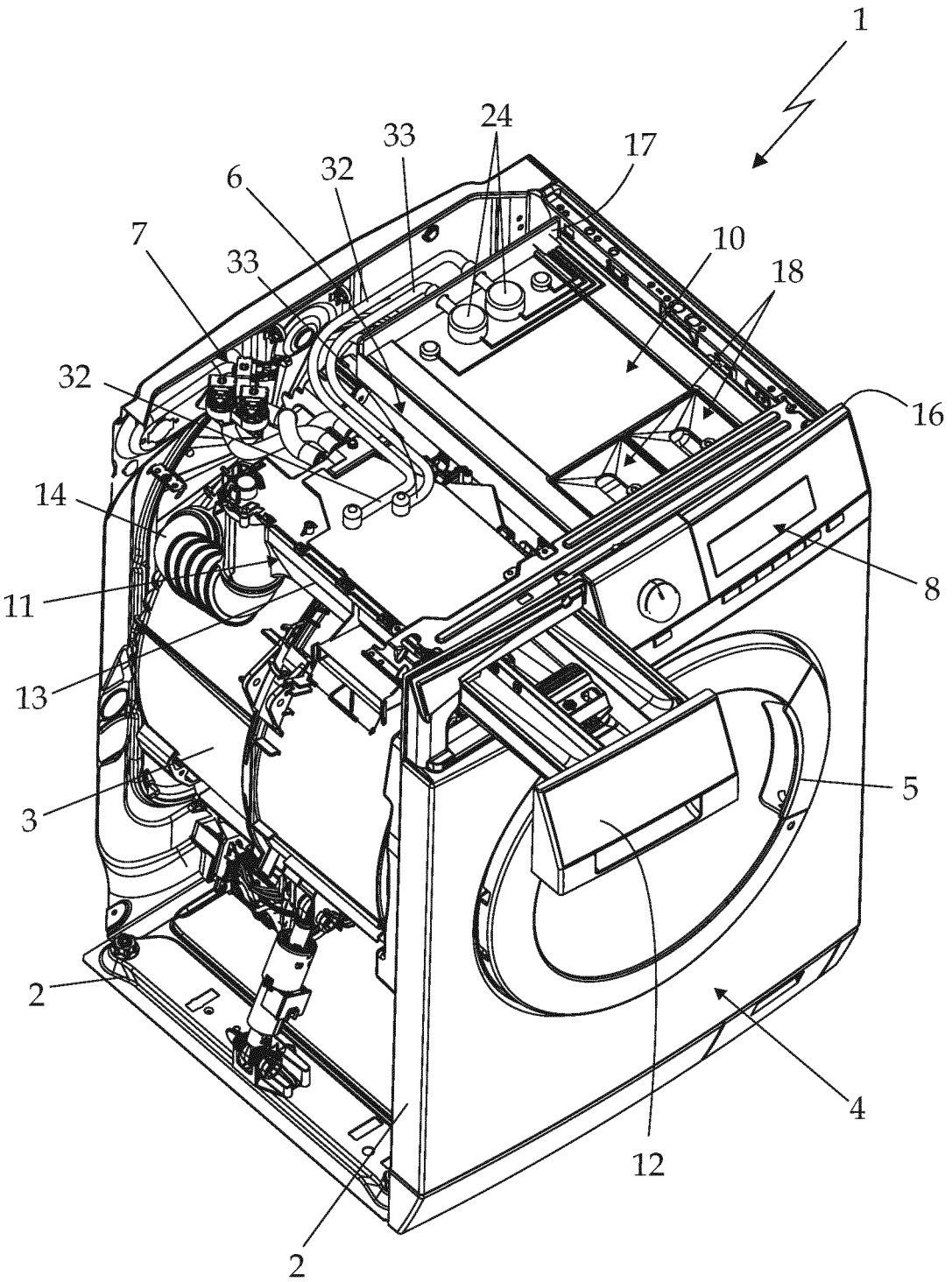
FIG. 10 is a perspective view, with parts in section and/or parts removed for clarity, of the FIG. 1 front-loading, laundry washing machine provided with a further embodiment of the FIG. 3 detergent dispensing assembly.
Figure 11:
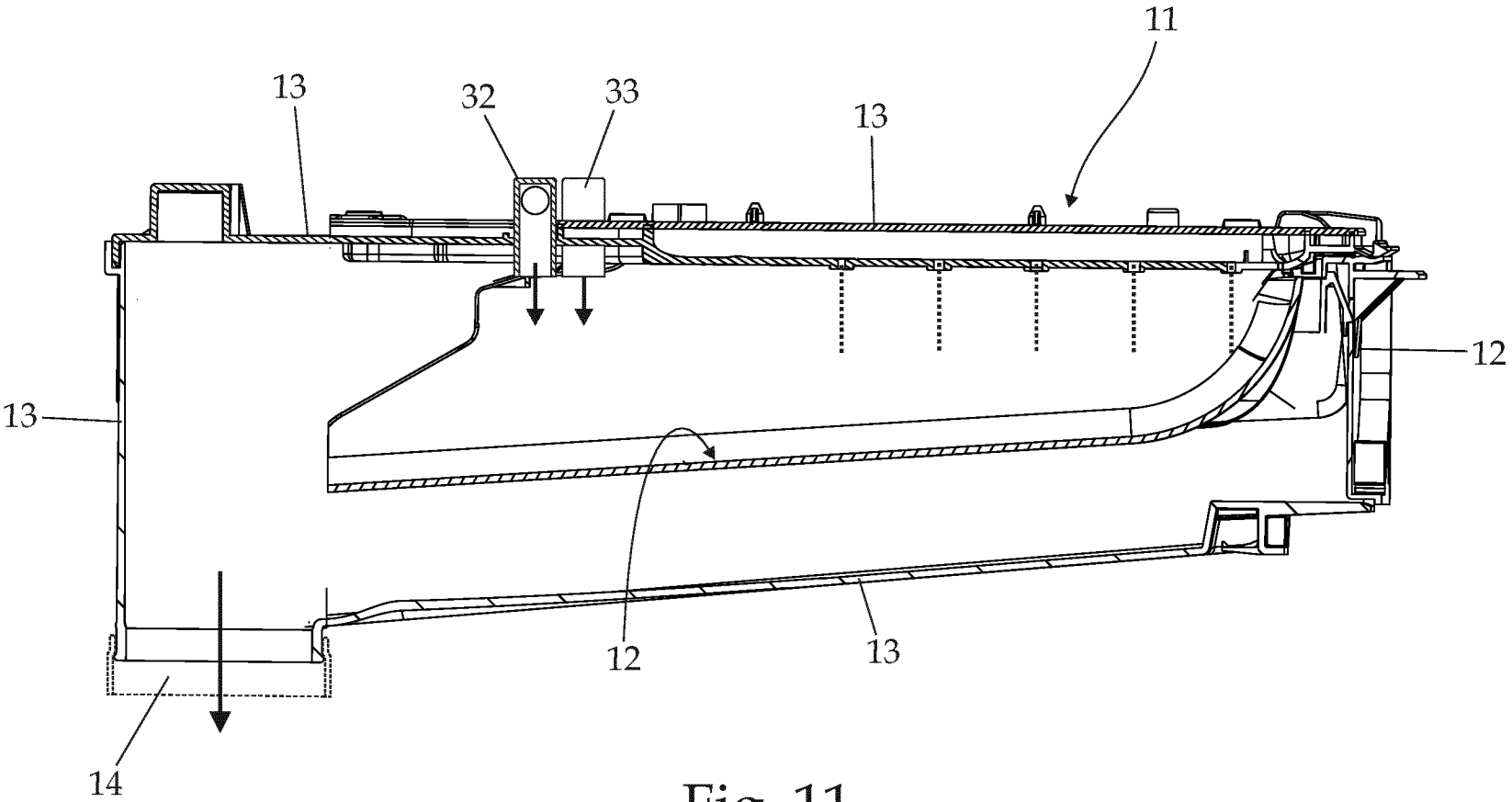

With reference to FIGS. 10 and 11, according to a further embodiment of the autodosing detergent dispenser 10, drawer housing 13 of the single-dose detergent dispenser 11 forms the detergent collecting chamber 22.

In this alternative embodiment, therefore, the autodosing detergent dispenser 10 lacks the connecting duct or pipeline 23 and the water supply circuit 26, and preferably comprises two connecting ducts or pipelines 32 and 33 each fluidly connecting the delivery of a respective detergent feeding pump 24 to the inside of drawer housing 13.

Figure 12:
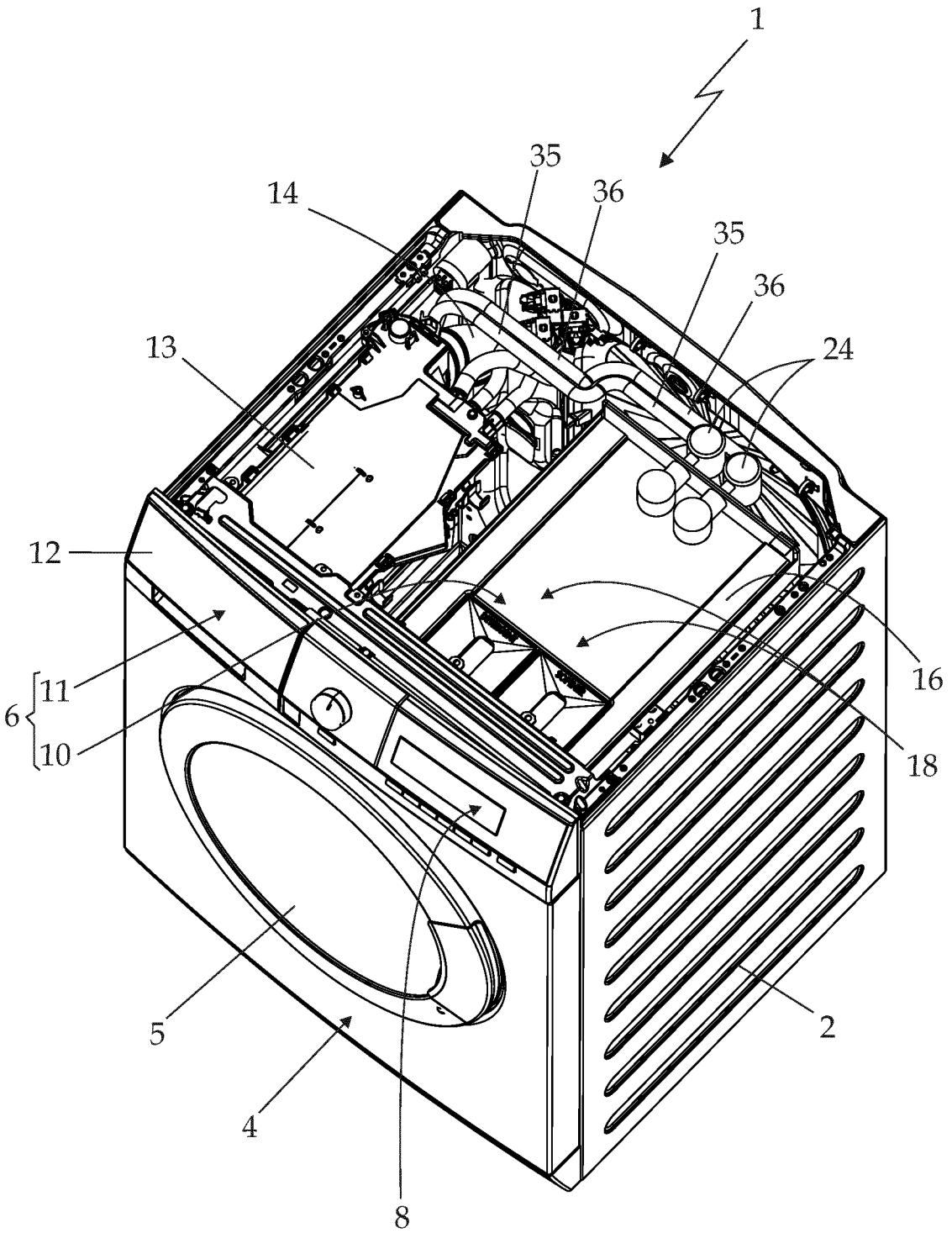
FIG. 12 is a perspective view, with parts in section and/or parts removed for clarity, of the FIG. 1 front-loading, laundry washing machine provided with a further alternative embodiment of the FIG. 3 detergent dispensing assembly.

With reference to FIG. 12, according to a further alternative embodiment of the autodosing detergent dispenser 10, the detergent collecting chamber 22 may be incorporated into the connecting duct 14 that connects the bottom portion (not shown) of drawer housing 13 to the inside of washing tub 3, or may be incorporated directly into the washing tub 3.

In other words, the detergent collecting chamber 22 may consists in a portion of the connecting duct 14, or may consists in the washing tub 3 itself.

In this alternative embodiment, therefore, the autodosing detergent dispenser 10 lacks the connecting duct or pipeline 23 and the water supply circuit 26, and preferably comprises to connecting ducts or pipelines 35 and 36 each fluidly connecting the delivery of a respective detergent feeding pump 24 to the inside of connecting duct 14, or to the inside of washing tub 3.

Finally according to a further non-shown alternative embodiment of the laundry washing machine 1, the detergent dispensing assembly 6 may lack the single-dose detergent dispenser 11, and the detergent drawer 12 may be replaced by a second drawer-like supporting structure which is fitted/inserted in extractable manner into a corresponding, completely recessed, drawer housing that takes the place of drawer housing 13. This second drawer-like supporting structure may be provided with one or more storage compartments which became accessible to the user when the second drawer-like supporting structure is arranged in the extracted position, and which are dimensioned for storing small washing agent containers, brushes and/or any other tools useful in laundry washing operations, such as, for example, a hand-held, substantially pen-shaped, ultrasonic garment stain-removal tool like the one disclosed in EP-1553161.

The invention claimed is:

1. A laundry washing machine comprising an outer casing, a washing tub which is arranged inside the casing with its opening or mouth directly facing a laundry loading/unloading opening realized on a front wall of the casing, a detergent dispensing assembly which is structured for supplying detergent into the washing tub, a main fresh-water supply circuit which is structured for being connected to a water mains and for selectively channelling a flow of fresh water from the water mains to the detergent dispensing assembly and/or to the washing tub, and an appliance control panel which is structured for allowing the user to manually select the desired washing-cycle;

wherein the detergent dispensing assembly comprises an autodosing detergent dispenser which is structured for automatically dosing, on the basis of the selected washing cycle, the suitable amount of detergent, softener and/or other washing agent to be used during the selected washing cycle, and which comprises:

one or more detergent reservoirs each of which is structured for receiving a quantity of detergent, softener or other washing agent for performing a plurality of washing cycles; and for each detergent reservoir, a respective detergent feeding pump which is structured to selectively suck, from the corresponding detergent reservoir, the amount of the detergent, softener or other washing agent for performing the selected washing cycle, and to pump/channel said specific amount of detergent, softener or other washing agent into a detergent collecting chamber fluidly communicating with the washing tub;

wherein the laundry washing machine comprises a drawer-like supporting structure which is fitted/inserted in extractable manner into a corresponding drawer housing that extends inside the casing underneath an upper worktop or top wall of the casing, and communicates with the outside via a front entrance or opening provided at the front wall of the casing;

the appliance control panel being incorporated on a front side of the drawer-like supporting structure;

the one or more detergent reservoirs of the autodosing detergent dispenser being located/housed on the drawer-like supporting structure behind the appliance control panel, and said drawer-like supporting structure being movable between a retracted position in which the drawer- like supporting structure is completely recessed/inserted into the drawer housing , and an extracted position in which the drawer-like supporting structure partly juts out from the front wall of the casing so as to arrange the loading inlets or mouths of the one or more detergent reservoirs outside of the casing;

wherein each detergent feeding pump permanently communicates with one between the corresponding detergent reservoir and the detergent collecting chamber regardless of the position of the drawer-like supporting structure; and the laundry washing machine furthermore comprises a movable connecting device which is structured to put in fluid communication each detergent feeding pump to the detergent collecting chamber and the corresponding detergent reservoir, wherein said connecting device is movable together with the drawer-like supporting structure and is structured to fluidly couple each detergent feeding pump to the corresponding detergent collecting chamber when the drawerlike supporting structure is arranged in the retracted position, and to fluidly uncouple each detergent feeding pump from the corresponding detergent collecting chamber when the drawer-like supporting structure is arranged in the extracted position;

wherein each detergent feeding pump comprises a pumping assembly and an electric-motor assembly which are separate from one another, and are structured to reciprocally couple so as to allow the electric-motor assembly to drive the pumping assembly, wherein the pumping assembly is located on the drawer-like supporting structure so as to suck the detergent, softener or other washing agent from the corresponding detergent reservoir, and fluidly coupled to the detergent collecting chamber via the movable connecting device, and wherein the electric-motor assembly is fixed inside the casing so as to couple with the corresponding pumping assembly through the collecting chamber via the movable connecting device when the drawer-like supporting structure is arranged in the retracted position.

2. A laundry washing machine according to claim 1, wherein each detergent feeding pump is at least partly located on the drawer-like supporting structure with the suction in permanent communication with the corresponding detergent reservoir; and the movable connecting device is structured to selectively fluidly couple each detergent feeding pump with the detergent collecting chamber.

3. A laundry washing machine according to claim 1, wherein each detergent feeding pump is arranged stationary inside the casing with the delivery of the detergent feeding pump in permanent fluid communication with the detergent collecting chamber; and the movable connecting device is structured to selectively fluidly couple each detergent feeding pump with the corresponding detergent reservoir.

4. A laundry washing machine according to claim 1, wherein the detergent collecting chamber of the autodosing detergent dispenser is located outside of the drawer-like supporting structure, stationary inside the outer casing.

5. A laundry washing machine according to claim 1, wherein the detergent collecting chamber is located outside the washing tub and is arranged between the drawer housing and the back wall or a sidewall of the outer casing.

6. A laundry washing machine according to claim 1, wherein the detergent collecting chamber comprises a container or receptacle which is located outside of the drawer housing, as a separate piece attached to the drawer housing, or is at least partially realized in a one-piece construction with the drawer housing.

7. A laundry washing machine according to claim 1, wherein the movable connecting device comprises, for each detergent feeding pump, a respective delivery manifold which is arranged on the back side of a drawer- like supporting structure.

8. A laundry washing machine according to claim 1, wherein the movable connecting device comprises, for each detergent feeding pump, a respective delivery manifold, said delivery manifold protrudes from the back side of the drawer-like supporting structure, and is structured so as to directly face a corresponding pass-through opening or hole realized on a lateral wall of the detergent collecting chamber when the drawer- like supporting structure is arranged in the retracted position.

9. A laundry washing machine according to claim 1, wherein the movable connecting device comprises, for each detergent feeding pump, a respective delivery manifold, said delivery manifold is structured so as to plug/fit in easy extractable manner into a corresponding pass-through opening or hole realized on the detergent collecting chamber when the drawer-like supporting structure is arranged in the retracted position.

10. A laundry washing machine according to claim 1, wherein the autodosing detergent dispenser additionally comprises a first water supply circuit which is connected or incorporated to the fresh-water supply circuit, and is structured for selectively channelling some fresh water into the detergent collecting chamber, so as to selectively flush/push any amount of detergent, softener or other washing agent out of the detergent collecting chamber and into the washing tub.

11. A laundry washing machine according to claim 1, wherein the appliance control panel is arranged substantially coplanar to the front wall of the casing when the drawer-like supporting structure is in the retracted position.

12. A laundry washing machine according to claim 1, wherein said detergent reservoir/s is/are housed into the drawer- like supporting structure in manually removable manner.

13. A laundry washing machine according to claim 12, wherein each detergent feeding pump is housed or incorporated into the corresponding detergent reservoir so as to be manually removable from the drawer-like supporting structure together with the corresponding detergent reservoir.

14. A laundry washing machine according to claim 1, wherein the detergent dispensing assembly also comprises a single-dose detergent dispenser which is housed inside the casing above the washing tub and is structured for selectively feeding into the washing tub an amount of detergent, softener and/or other washing agent sufficient for performing a single washing cycle.

15. A laundry washing machine according to claim 14, wherein the single-dose detergent dispenser is housed inside the casing horizontally beside the autodosing detergent dispenser.

16. A laundry washing machine according to claim 14, wherein the single-dose detergent dispenser comprises a detergent drawer which is manually fillable with a quantity of detergent, softener and/or other washing agent sufficient for performing a single washing cycle, and which is fitted/inserted in manually extractable manner into a corresponding drawer housing which extends inside the casing underneath the upper worktop or top wall of the casing, and communicates with the outside via a front entrance or opening which is realized on the front wall of the casing above the laundry loading/unloading opening and horizontally beside the front entrance or opening of the drawer housing of the drawer-like supporting structure.

17. A laundry washing machine according to claim 16, wherein the drawer housing of the detergent drawer has a substantially basin-shaped bottom portion which communicates with the inside of the washing tub via a suitable first connecting duct, and the detergent collecting chamber communicates with the inside of the washing tub via a second connecting duct which joins the first connecting duct immediately upstream of the washing tub.

18. A laundry washing machine according to claim 16, wherein the drawer housing of the detergent drawer has a substantially basin-shaped bottom portion which communicates with the inside of the washing tub via a suitable first connecting duct, and the detergent collecting chamber is a portion of said first connecting duct.

19. A laundry washing machine according to claim 16, wherein the drawer housing of the detergent drawer has a substantially basin-shaped bottom portion which communicates with the inside of the washing tub and the drawer housing of the detergent drawer of the single-dose detergent dispenser forms the detergent collecting chamber.

20. A laundry washing machine according to claim 1, wherein the detergent collecting chamber is arranged above the washing tub.

21. A laundry washing machine according to claim 1, wherein the detergent collecting chamber is incorporated into the washing tub.

22. A laundry washing machine comprising an outer casing, a washing tub which is arranged inside the casing with its opening or mouth directly facing a laundry loading/unloading opening realized on a front wall of the casing, a detergent dispensing assembly which is structured for supplying detergent into the washing tub, a main fresh-water supply circuit which is structured for being connected to a water mains and for selectively channelling a flow of fresh water from the water mains to the detergent dispensing assembly and/or to the washing tub, and an appliance control panel which is structured for allowing the user to manually select the desired washing-cycle;

wherein the detergent dispensing assembly comprises an autodosing detergent dispenser which is structured for automatically dosing, on the basis of the selected washing cycle, the suitable amount of detergent, softener and/or other washing agent to be used during the selected washing cycle, and which comprises:

one or more detergent reservoirs each of which is structured for receiving a quantity of detergent, softener or other washing agent for performing a plurality of washing cycles; and for each detergent reservoir, a respective detergent feeding pump including a pumping assembly and an electric-motor assembly is structured to selectively suck, from the corresponding detergent reservoir, the amount of the detergent, softener or other washing agent for performing the selected washing cycle, and to pump/channel said specific amount of detergent, softener or other washing agent into a detergent collecting chamber fluidly communicating with the washing tub;

wherein each detergent feeding pump including the pumping assembly and the electric-motor assembly is located inside the corresponding detergent reservoir;

wherein the laundry washing machine comprises a drawer-like supporting structure which is fitted/inserted in extractable manner into a corresponding drawer housing that extends inside the casing underneath an upper worktop or top wall of the casing, and communicates with the outside via a front entrance or opening provided at the front wall of the casing;

the appliance control panel being incorporated on a front side of the drawer-like supporting structure;

the one or more detergent reservoirs of the autodosing detergent dispenser being located/housed on the drawer-like supporting structure behind the appliance control panel, and said drawer-like supporting structure being movable between a retracted position in which the drawer- like supporting structure is completely recessed/inserted into the drawer housing, and an extracted position in which the drawer-like supporting structure partly juts out from the front wall of the casing so as to arrange the loading inlets or mouths of the one or more detergent reservoirs outside of the casing;

wherein each detergent feeding pump permanently communicates with the corresponding detergent reservoir regardless of the position of the drawer-like supporting structure, and wherein each detergent feeding pump includes a movable connecting device which protrudes from the reservoir to put in fluid communication each detergent feeding pump to the detergent collecting chamber when the drawer-like supporting structure is arranged in the retracted position.

* * * * *